US006865999B2

(12) United States Patent
Bierbower, Jr.

(10) Patent No.: US 6,865,999 B2
(45) Date of Patent: Mar. 15, 2005

(54) WATERSPORT TOWERS

(76) Inventor: William John Bierbower, Jr., 1580 Harvest La., Alpharetta, GA (US) 30004

( * ) Notice: Subject to any disclaimer, the term of this patent is extended or adjusted under 35 U.S.C. 154(b) by 0 days.

(21) Appl. No.: 10/787,336

(22) Filed: Feb. 26, 2004

(65) Prior Publication Data

US 2004/0144295 A1 Jul. 29, 2004

(51) Int. Cl.[7] ..... B63B 21/04
(52) U.S. Cl. ..... 114/253; 114/364
(58) Field of Search ..... 114/242, 253, 114/254, 343, 361, 364

(56) References Cited

U.S. PATENT DOCUMENTS

| | | | | | |
|---|---|---|---|---|---|
| 5,520,139 | A | * | 5/1996 | King et al. | 114/361 |
| 5,979,350 | A | * | 11/1999 | Larson et al. | 114/253 |
| 6,044,788 | A | * | 4/2000 | Larson et al. | 114/253 |
| 6,192,819 | B1 | * | 2/2001 | Larson et al. | 114/253 |
| 6,374,762 | B1 | | 4/2002 | Larson et al. | |
| RE37,823 | E | | 9/2002 | Larson et al. | |

OTHER PUBLICATIONS

U.S. Appl. No. 09/200,307, filed Feb. 26, 2004, Bierbower.
Roswell Wake Air, http://www.roswellwakeair.com, downloaded Nov. 14, 2002.
Photographs taken by Bill Bierbower of public exhibits at Surf Expo 2002, Orlando Fl, Jul. 25, 2002.
Samson Sports, http://www.samsonsports.com, downloaded Aug. 19, 2002.
Epco Towers and GatorTuff.com, http://gatortuff.com, downloaded Jul. 25, 2002.
Mounts, http://www.wakeair.com/start/towers/mounts.htm, downloaded Aug. 22, 2002.
Fitting Information, http://www.3rdleg.com/cgi–bin/framed/1902/UniFittings.htm, downloaded Jul. 24, 2002.
Overton's Detail, http://www.overtons.com/cgi–bin/overtons/order/large.cgi? 18768, downloaded Jul. 22, 2002.
Installation Instructions for Barewest Mini Tower, Barewest, received Jul. 25, 2002.
Universal Tower, http://www.joystickpylons.com/tower.htm, 3 pages, downloaded Jul. 28, 2002.
Atlantic Towers, Tower Systems, Inc., including cover letter, photographs, and product listing, 3 pages, received Nov. 5, 2002.
Tower,XtremeTowers, PartsListandToolsRequired,Installation,Assmbly Sch, 11 pages, http://www.xtremetowers.com/xtremetower.html, downloaded Jul. 20, 2002.
SkyJac Tower Installation Instructions, 5 pages http://www.skyjac.com, downloaded Sep. 17, 2002.
Tuff Tower, http://www.waketower.com/more_epco_tuff.html, downloaded Mar. 17, 2003.

(List continued on next page.)

*Primary Examiner*—Lars A. Olson
(74) *Attorney, Agent, or Firm*—Withers & Keys, LLC

(57) ABSTRACT

Watersport towers provide various features including legs that rotate relative to a cross-member of the tower that the legs are hingedly attached to such that the tower may adjust to various boat sizes and mounting locations, so that the tower may fold down in a first manner, and so that the tower is more compliant. Other features include leg attachment points of the cross-member that rotate to further allow the tower to adjust to various boat sizes and to allow the tower to fold down in an alternative manner. Other features include mounting bases that hingedly connect to the ends of the tower legs enabling the mounting bases to rotate relative to the legs such that the mounting bases can adapt to various boat mounting locations ranging from horizontal to vertical. Additionally, pads with recessed areas surrounding mounting holes may be utilized at the point of attachment to a boat to remove stress at the mounting holes of the boat.

24 Claims, 19 Drawing Sheets

OTHER PUBLICATIONS

Wake Designs Tower Installation Instructions, Wake Designs, received Jul. 25, 2002.

Joystick, Parts List (Roll cage), Parts List (Tower), 8 pages, http://www.joystickpylons.com, downloaded Sep. 27, 2002.

Tower Fitting Chart: Skyjac Swoop Minit Tower (ST1000W), Tower Fitting Chart: Skyjac Universal Tower (ST1000UN), 2 pages, received Sep. 27, 2002.

Samson Sports Tower Mounting Instructions, 3 pages, http://www.samsonsports.com, Jun. 2002.

Wake Boarding, Swoop Tower Ad, Big Air Pylons Ad p. 110, Air Boom Ad, 4 pages, vol. 10, No 6, Jul. 2002.

Alliance Wakeboarding, Titan Ad pp. 26–27, Wake Designs Ad, Wakeboard Towers Inc. Ad, 5 pages, vol. 2002.8, Oct./Nov. 2002.

Level X, Joystick Ad, Swoop Tower and Swoop S Tower Ads p. 46, Boss Billet Tower Ad p. 52, Phat Bude Ad p. 59, Titan Ad p. 65, Issue 5, 2002.

* cited by examiner

WATERSPORT TOWERS

TECHNICAL FIELD

The present invention relates to towers installed on boats for towing an object or person during wakeboarding or other watersport activities.

BACKGROUND

Watersport towers allow enthusiasts to be towed behind a boat that the watersport tower is mounted on. The structure is shaped as a tower to provide a stable point for the force of a tow rope to be applied, and the tow rope is often attached to a lug also know as a tow point at the top of the tower to maintain the tow rope at an elevated position above the rear passenger area of a boat so as to improve the performance of a wakeboarder or other enthusiast. Various designs of watersport towers have been developed for this purpose.

Simple watersport towers are essentially a U-shaped portion flipped upside down and permanently coupled at the top to two additional braces. This coupling of the U-shaped piece and braces provides four legs to be attached to the boat structure. Other early shapes used are two tandem U-shaped portions flipped upside down with braces permanently extending between the U-shaped portions. These tandem U-shaped portions also provide four legs to be attached to the boat structure. These towers provide a stable structure from which to tow a wakeboarder.

However, these tower designs present drawbacks. The tower mounts are fixed resulting in a non-compliant structure that potentially causes damage to the boat structure due to the boat flexing by design during operation. The gel coat and fiberglass of the boat has been known to crack at the points of attachment of a rigidly mounted tower, especially at the bolt holes. Another drawback is that the structure is permanently fixed in place on the boat and thereby prevents a standard boat cover from being placed over the boat and/or prevents the boat from being adequately raised by an overhead boat lift due to lack of overhead clearance. An additional drawback is that the tower has its mounting points essentially fixed such that the tower cannot adapt from one size boat to another.

Other wakeboard towers include a mounting attachment to the boat that allows the front legs to detach from the boat while allowing the tower to pivot about the attachment of the rear legs. Alternatively, some allow the rear legs to detach and then allow the tower to pivot about the attachment of the front legs. This allows the tower to rotate backward for some about the attachment of the rear legs and into a reclined position or allows rotation forward about the attachment of the front legs for others. However, for some of these towers, another problem is that the front legs rest atop the windshield of the boat, applying unwanted stress to the frame of the windshield. Furthermore, the front or rear legs typically extend well above the windshield thereby continuing to hinder the use of standard boat covers and overhead boat lifts. Also, these wakeboard towers continue to present a non-compliant structure that potentially causes damage to the boat during operation, and these towers also lack the ability to adapt from one size boat to another.

SUMMARY

Embodiments of the present invention address these issues and others by providing watersport towers that include various features absent in earlier watersport towers. For example, features of some embodiments provide for the adaptation of the tower for different size boats and boats with differing mounting positions. Features of some embodiments provide for a compliant structure that results in less undue stress when the boat structure flexes. Features of some embodiments provide for a tower that can be folded down in one or more ways to allow a standard boat cover or overhead lift to be used. Furthermore, features of some embodiments provide for mounting to a boat while reducing the stress applied by the presence of the tower itself to the mounting holes in the boat structure.

One embodiment of a watersport tower includes a first leg including a first end providing a cross-member attachment point and a second end providing a boat attachment point. A second leg includes a first end providing a cross-member attachment point and a second end providing a boat attachment point. A cross-member includes at least two attachment points, with the cross-member attachment point of the first leg being hingedly connected to a first attachment point of the cross-member, and with the cross-member attachment point of the second leg being hingedly connected to a second attachment point of the cross-member The first leg pivots about the hinged connection to the first attachment point to swing toward and away from the second leg and the second leg pivots about the hinged connection to the second attachment point to swing toward and away from the first leg. A third leg includes an end providing a boat attachment point, and the third leg is linked to the cross-member. A fourth leg includes an end providing a boat attachment point, and the fourth leg is linked to the cross-member. A tow constraint is also linked to the cross-member.

Another embodiment is a watersport tower that includes a first leg including an end providing a boat attachment point. A second leg includes an end providing a boat attachment point. A third leg includes a first end providing a cross-member attachment point and a second end providing a boat attachment point. A fourth leg includes a first end providing a cross-member attachment point and a second end providing a boat attachment point. A cross-member is linked to the first and second legs and includes at least two attachment points separated by a central portion. The cross-member attachment point of the third leg is attached to a first attachment point of the cross-member, and the cross-member attachment point of the fourth leg is attached to a second attachment point of the cross-member. The third and fourth attachment points rotate relative to the central portion to allow the third leg to swing toward and away from the first leg and to allow the fourth leg to swing toward and away from the second leg. A tow constraint is linked to the cross-member.

Another embodiment is a watersport tower that includes a first leg including a first end providing a cross-member attachment point and a second end providing a boat attachment point. A second leg includes a first end providing a cross-member attachment point and a second end providing a boat attachment point. A third leg includes a first end providing a cross-member attachment point and a second end providing a boat attachment point. A fourth leg includes a first end providing a cross-member attachment point and a second end providing a boat attachment point. A cross-member includes four attachment points. The cross-member attachment point of the first leg is hingedly connected to a first attachment point of the cross-member, and the cross-member attachment point of the second leg is hingedly connected to a second attachment point of the cross-member. The first leg pivots about the hinged connection to the first attachment point to swing toward and away from the second leg and the second leg pivots about the hinged connection to the second attachment point to swing toward and away from the first leg. The cross-member attachment point of the third leg is hingedly connected to the third attachment point of the cross-member, and the cross-member attachment point of the fourth leg is hingedly connected to the fourth attachment point of the cross-member. The third leg pivots about the third attachment point and the fourth leg pivots about the fourth attachment point to allow the third leg to swing toward and away from the fourth leg and to allow the fourth leg to swing toward and away from the third leg. The cross-member further comprises a central portion and the third and fourth attachment points rotate relative to the central portion to allow the third leg to swing toward and away from the first leg and to allow the fourth leg to swing toward and away from the second leg. A tow constraint is linked to the cross-member.

Another embodiment is a watersport tower that includes a plurality of coupled legs, each leg providing a boat attachment point. A tow constraint is coupled to the plurality of legs. A first set of mounting bases are included, with each mounting base being coupled to one of the boat attachment points, and each mounting base includes at least one mounting hole. A first set of pads are included, and each pad abuts a mounting base of the first set and includes at least one mounting hole in registry with the at least one mounting hole of the mounting base from the first set. Each pad includes a recessed portion surrounding the at least one mounting hole on a side of the pad opposite the mounting base of the first set.

Another embodiment is a watersport tower that includes a plurality of coupled legs including front and rear legs for left and right sides with each leg providing a boat attachment point. A tow constraint is coupled to the plurality of legs. Swivel members are connected to the boat attachment point of each leg and include a bolt hole. Mounting bases of a first set include a bolt hole and each mounting base abuts a swivel member with the bolt hole of the mounting base in registry with the bolt hole of the swivel member. A bolt passes through the bolt hole of each mounting base and the bolt hole of each swivel member to provide an axis of rotation of the mounting base relative to the swivel member such that the mounting base rotates relative to the leg until the bolt is tightened to fix the mounting base against the swivel.

Another embodiment is a method of folding a watersport tower that has two front legs and two rear legs and that is mounted to a boat. The method involves rotating the watersport tower about a point of attachment of the two rear legs to the boat until the watersport tower comes to rest in a reclined position. After rotating the watersport tower, the method further involves rotating the two front legs inward until one front leg crosses-over the other front leg and each front leg comes to rest.

Another embodiment is a method of folding a watersport tower that has two front legs and two rear legs and that is mounted to a boat. The method involves rotating the watersport tower about a point of attachment of the two rear legs to the boat until the watersport tower comes to rest in a reclined position. After rotating the watersport tower, the method further involves rotating the two front legs inward and stopping prior to both the front legs coming to rest. After rotating the two front legs inward, the method further involves rotating the two front legs downward until the two front legs come to rest.

Another embodiment is a method of packaging components of a watersport tower including a cross-member with a tow lug and a plurality of curved legs. The method involves positioning the plurality of curved legs side by side such that the curvature of the plurality of curved legs is substantially concentric and so that an innermost curved leg defines a central empty region. The plurality of curved legs defines a first plane. The method further involves positioning the plurality of curved legs in a stacked configuration with the cross-member such that the tow lug of the cross-member extends into the central empty region. The cross-member defines a second plane that is adjacent the first plane.

DETAILED DESCRIPTION

Embodiments of the present invention include watersport towers and associated methods of folding the watersport towers from an upright state to a folded state. Certain embodiments of watersport towers include various features such as legs hingedly attached allowing the widths between the front and/or rear legs to be adjustable so as to accommodate various boat widths. Certain embodiments of watersport towers include rotating collars to allow the distance between front legs and rear legs to be adjustable to accommodate different mounting positions. Furthermore, certain embodiments of watersport towers include mounting bases allowing rotation of the boat mounting points relative to the legs, which allows the legs to attach to areas of the boat ranging from horizontal to vertical. Features of certain embodiments provide for mounting with reduced stress to the boat structure and allow for compact packaging to transport the watersport tower.

As noted above, such watersport towers may be used to tow a person such as a wakeboarder as well as tow objects such as inner tubes or other boats. However, it will be appreciated that towing objects presents additional dangers to participants and by-standers and also poses a greater risk of damage to the boat upon which the tower is mounted. Accordingly, while towing an object is possible, it is not recommended.

Figure 1:
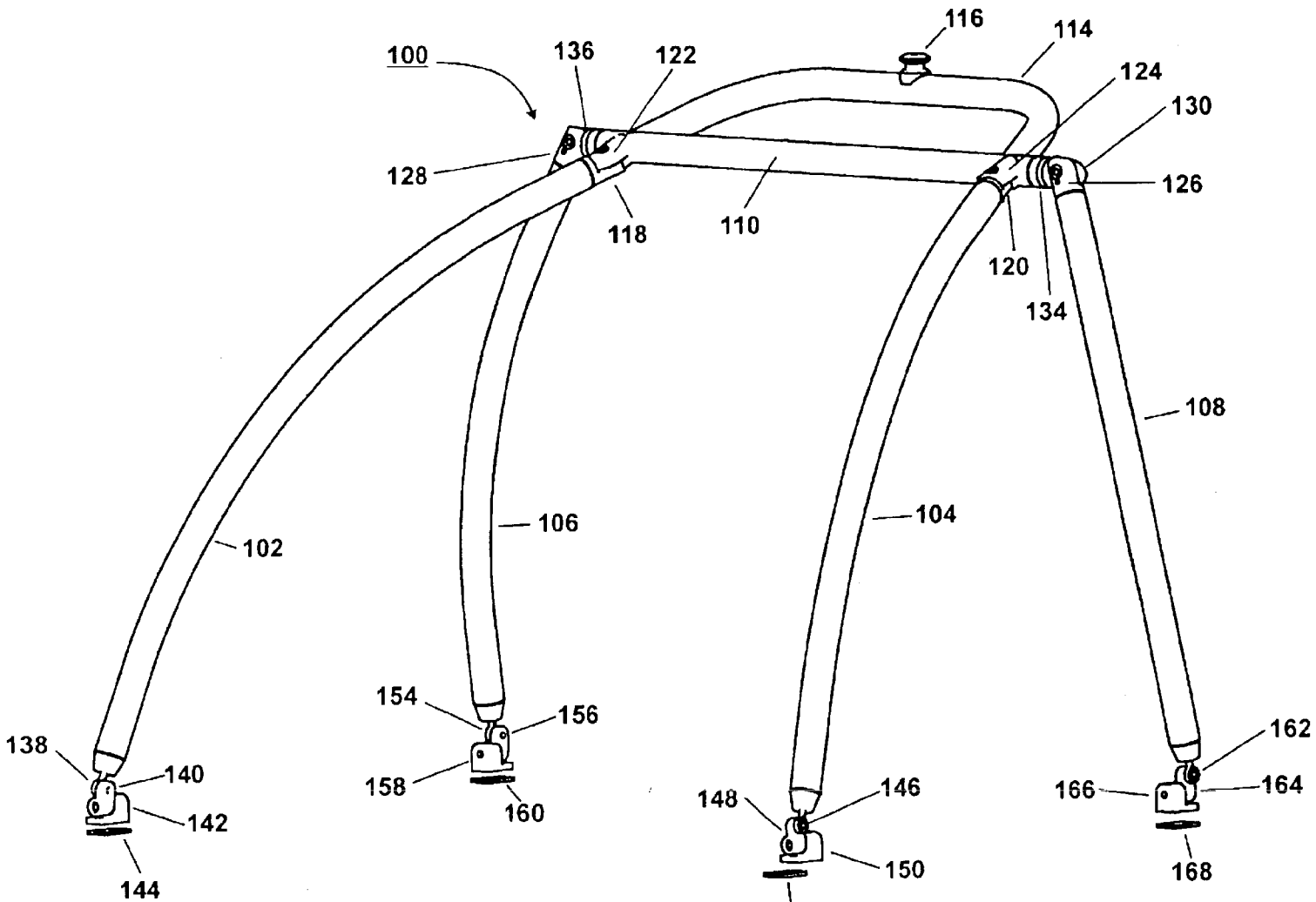
FIG. 1 is a perspective view of an embodiment of the present invention.
Figure 2:
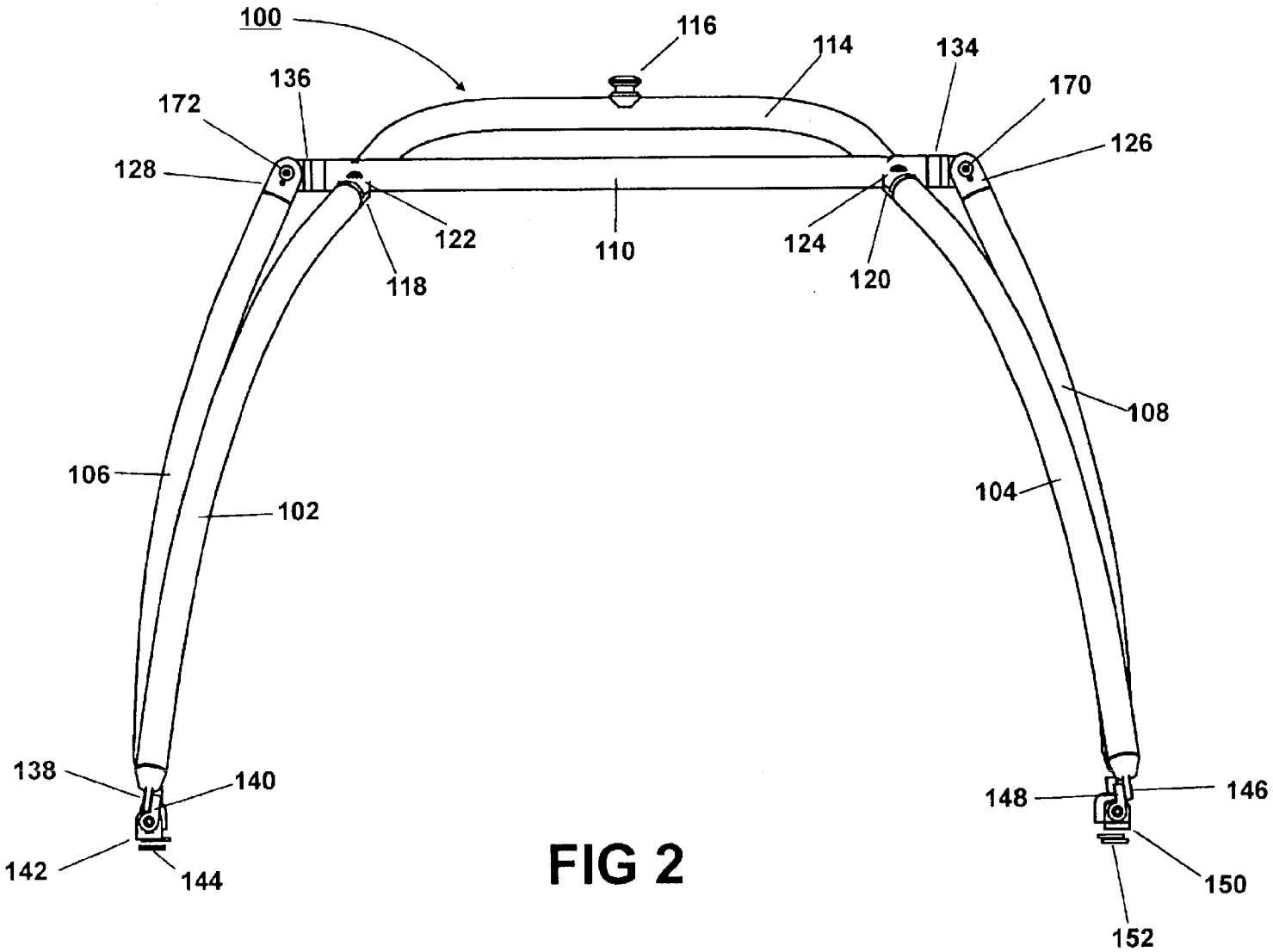
FIG. 2 is a front elevational view of the embodiment.
Figure 3:
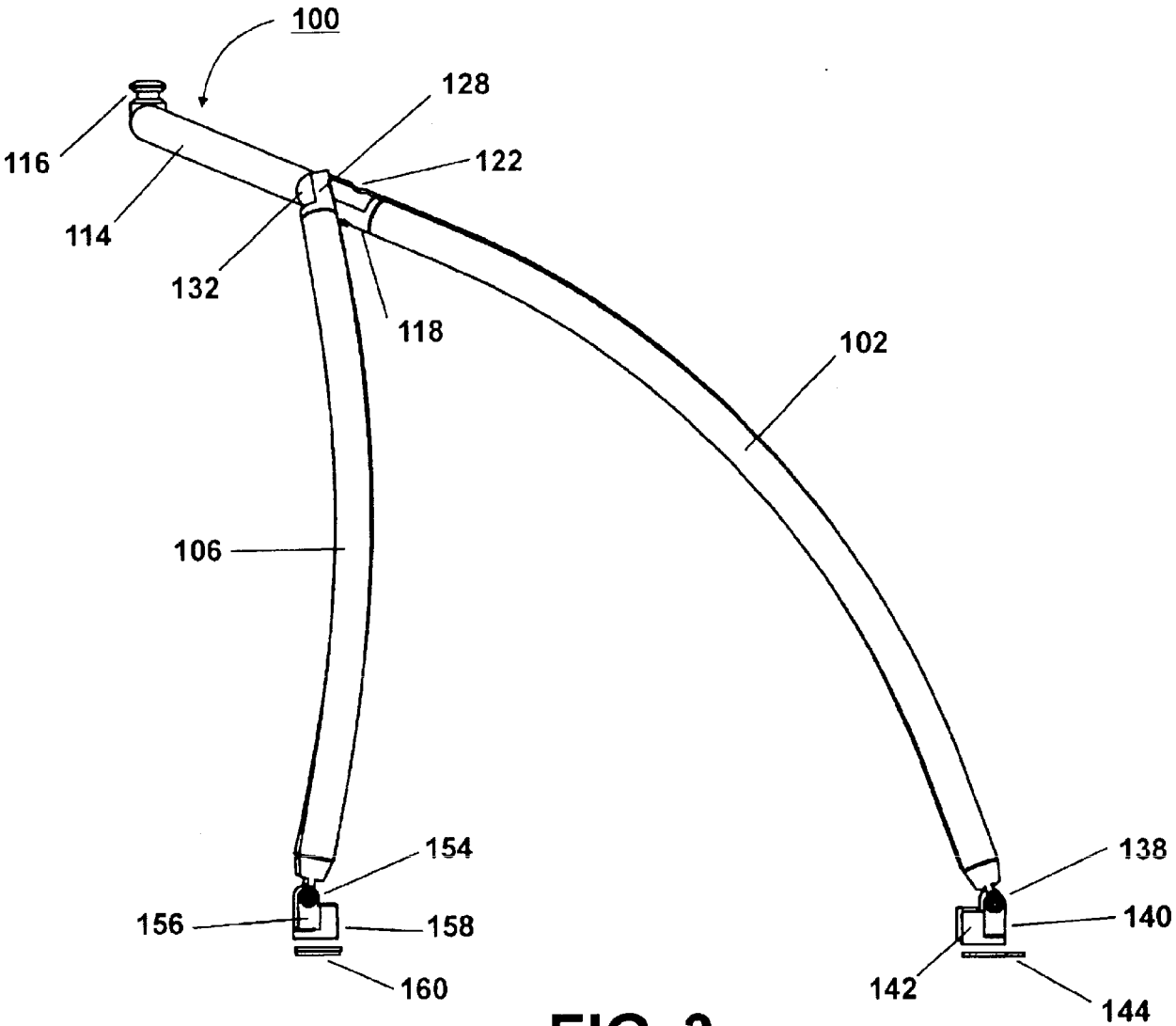
FIG. 3 is a side elevational view of the embodiment.

FIGS. 1–6 show various views of an illustrative embodiment 100 of a watersport tower. The watersport tower 100 of this particular embodiment includes four legs, two front legs 102 and 104 and two rear legs 106 and 108. As can be seen in the front view of FIG. 2 showing one plane and the side view of FIG. 3 showing another plane, the legs of this embodiment are shown curved in both of these planes. However, it will be appreciated that the legs may be curved in a single plane or may be linear.

The legs hingedly attach at the top of the watersport tower 100 to a cross-member 110. In the embodiment shown, the hinged attachment of the legs is a swivel-type connection, but it will be appreciated that other forms of a hinged connection are suitable as well for embodiments where it is desirable for the legs to rotate. It will also be appreciated that in some embodiments, the legs may be fixed rather than able to rotate. For leg 102 of the embodiment shown, the leg provides a swivel portion 118 that is a cross-member attachment point which mates to a swivel portion 122 that is a leg attachment point extending from the cross-member 110. A bolt 174 acts a pin about which the leg 102 hinges in relation to the swivel portion 122 to provide rotation. Likewise, leg 104 provides a swivel portion 120 that is a cross-member attachment point which mates to a swivel portion 124 that is a leg attachment point extending from the cross-member 110. A bolt 176 acts as a pin about which the leg 104 hinges in relation to the swivel portion 124 to provide rotation.

The hinged connections of the front legs 102 and 104 allow the legs to rotate so as to move toward and away from one another and thereby alter the distance between the boat attachment ends of the legs. This allows the tower 100 to accommodate various boat widths for the front leg mounting positions. As discussed below in relation to FIGS. 10–17, these hinged connections also allow the front legs 102 and 104 to rotate inward when folding down the tower.

The rear legs 106 and 108 also hingedly attach at the top of the watersport tower 100 to the cross-member 110. For leg 106, the leg provides a swivel portion 128 that is a cross-member attachment point which mates to a swivel portion 132 that is a leg attachment point extending from the cross-member 110. A bolt 172 acts a pin about which the leg 106 hinges in relation to the swivel portion 132 to provide rotation. Likewise, leg 108 provides a swivel portion 126 that is a cross-member attachment point which mates to a swivel portion 130 that is a leg attachment point extending from the cross-member 110. A bolt 170 acts as a pin about which the leg 108 hinges in relation to the swivel portion 130 to provide rotation.

The hinged connections of the rear legs 106 and 108 allow the legs to rotate toward and away from one another to thereby alter the distance between the boat attachment ends of the legs. This allows the watersport tower 100 to accommodate various boat widths for the rear leg mounting positions as well.

In addition to providing the swivel portions establishing hinged connections with the legs, the cross-member 110 also provides collars 134 and 136 on each end that allows swivel portions 130 and 132 to rotate about their longitudinal axis (i.e., running side-to-side) relative to the cross-member 110. The details of the collars 134 and 136 are discussed below in relation to FIG. 9 which shows a cross-sectional view taken through line A—A shown in FIG. 4. The rotation of the swivel portions 130 and 132 about their longitudinal axes allow for additional rotation of the legs 106 and 108 when mounted to the cross-member 110. Rear leg 106 can rotate toward and away from front leg 102 while rear leg 108 can rotate toward and away from leg front 104. This allows the watersport tower 100 to adapt to different lengths between the mounting positions of the front legs 102, 104 relative to the rear legs 106, 108.

The boat attachment ends of the legs interconnect to mounting bases to allow the legs to become attached to a boat. As shown, the legs are attached to the mounting bases by heim joints which allow for rotation, especially rotation at the point of attachment of the rear legs when folding down the tower as shown below. However, it will be appreciated that other forms of connection may also be used between the legs and the mounting bases for embodiments where it is desirable for the mounting bases and legs to be individual components that allow rotation such as that provided by heim joints. It will also be appreciated that for some embodiments, it may be desirable to have the legs and mounting bases permanently fixed together in a non-rotating manner.

In the embodiment shown, front leg 102 is hingedly attached at a boat attachment end to a mounting base 142 by a heim joint 138 connected to a swivel portion 140. A mounting pad 144 is placed under the mounting base 142 in this embodiment to provide protection to the boat structure. Details of the heim joints, mounting bases, and mounting pads are discussed in greater detail below with reference to FIGS. 7 and 8. Front leg 104 is hingedly attached at a boat attachment end to a mounting base 150 by a heim joint 146 connected to a swivel portion 148. A mounting pad 152 is placed under the mounting base 150 in this embodiment to provide protection to the boat structure. The swivel portions 140 and 148 allow the mounting bases 142 and 150 to rotate relative to the legs 102 and 104. This rotation allows the mounting bases 142 and 150 to be positioned in various positions ranging from horizontal (as shown) to vertical to accommodate various mounting locations on a boat structure. The heim joints 138 and 146 allow the legs 102 and 104 to approach and be coupled to the mounting bases 144 and 150 from various angles.

The front legs 102 and 104 may be released from the mounting bases 142 and 150 in multiple ways when removing the tower 100 from the boat or when folding down the tower as discussed below. The swivel portions 140 and 148 may be released from the heim joints 138 and 146. As an alternative, the swivel portions 140 and 148 may be released from the mounting bases 144 and 150.

Rear leg 106 is hingedly attached at a boat attachment end to a mounting base 158 by a heim joint 154 connected to a swivel portion 156. A mounting pad 160 is placed under the mounting base 158 in this embodiment to provide protection to the boat structure. Rear leg 108 is hingedly attached at a boat attachment end to a mounting base 166 by a heim joint 162 connected to a swivel portion 164. A mounting pad 168 is placed under the mounting base 166 in this embodiment to provide protection to the boat structure. The swivel portions 156 and 164 allow the mounting bases 158 and 166 to rotate relative to the legs 106 and 108. This rotation allows the rear mounting bases 158 and 166 to be positioned in various positions ranging from horizontal (as shown) to vertical to also accommodate various mounting locations on a boat structure. The heim joints 154 and 162 allow the legs 106 and 108 to approach and be coupled to the mounting bases 158 and 166 from various angles. The heim joints 154 and 162 also allow the legs to rotate relative to the swivel portions 156 and 164 to allow the tower 100 to rotate into a reclined position when folding down the tower 100 as discussed below.

Figure 7:
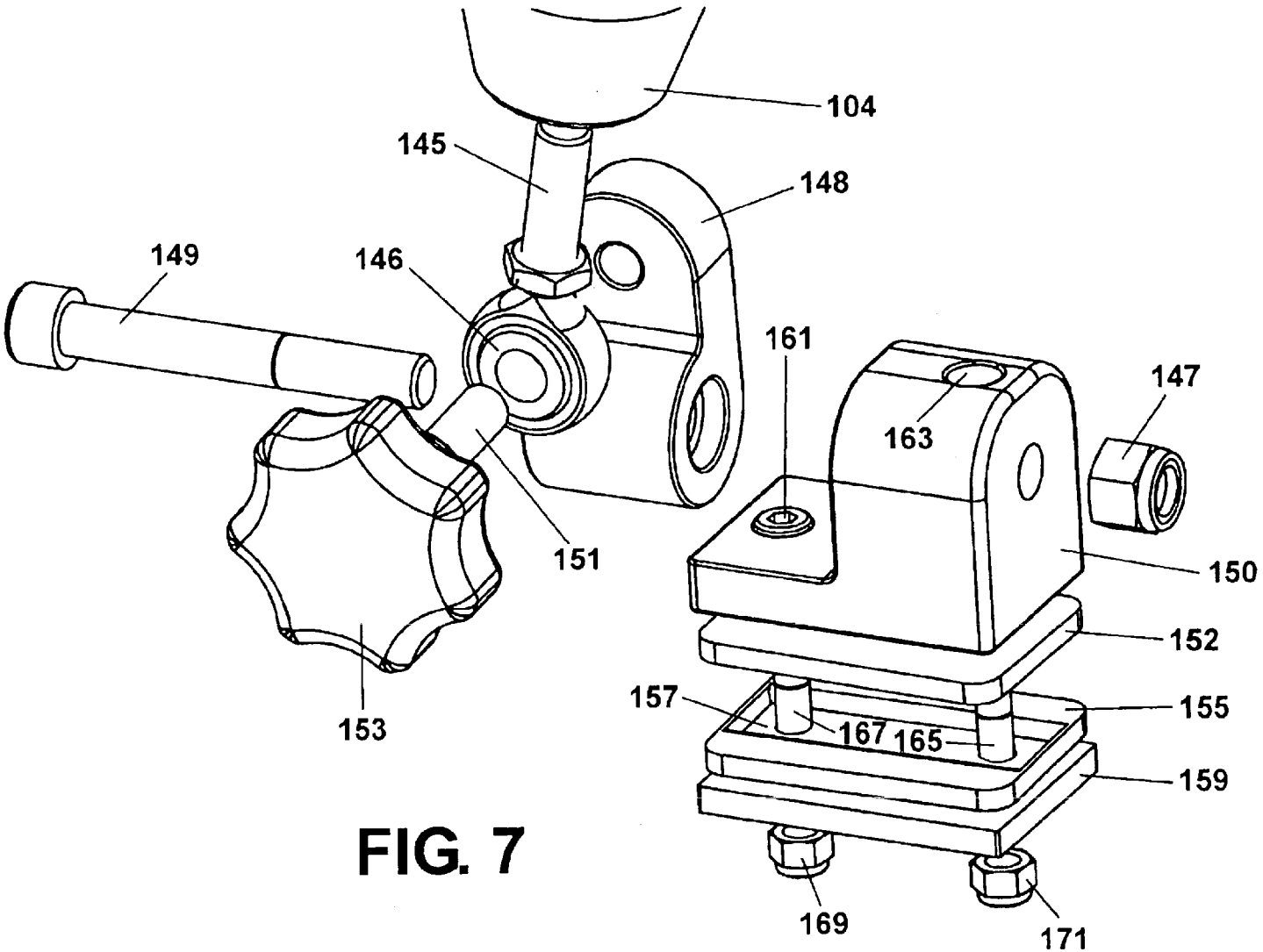
FIG. 7 is an exploded view of a mounting base assembly of the embodiment.

FIG. 7 is an exploded perspective view of the mounting base assembly for attaching the leg 104 to a boat. It will be appreciated that FIG. 7 is also representative of the other mounting base assemblies of the tower 100. The heim joint 146 includes a threaded portion 145 that screws into the bottom of the leg 104. A bolt 151 passes through the heim joint 146 to attach the heim joint to the swivel portion 148. The bolt 151 may include a knob 153 that enables a user to loosen and tighten the bolt 151 by hand to make releasing the legs from the boat a quick and easy task. A bolt 149 passes through a bolt hole in the swivel portion 148 and through a bolt hole of the mounting base 150 in registry with the bolt hole of the swivel portion 148. The bolt 149 is secured by nut 147 to hingedly connect the swivel portion 148 to the mounting base 150. This allows the mounting base 150 to rotate about an axis defined by the bolt 149 from a horizontal to a vertical mounting position. However, upon mounting the base 150 to a boat structure, the bolt 149 may be tightened to firmly press the mounting base 150 against the swivel portion 148. This fixed connection allows for no play between mounting base 150 and swivel portion 148 so as to avoid annoying chatter that is often present due to vibration during operation for unfixed floating connections of other watersport towers.

The mounting base 150 is attached to the boat by bolts 167 and 165 passing through bolt holes 161 and 163 with countersinks to allow the bolt heads to be located within the mounting base 150 and therefore, not interfere with bolt 149 and swivel portion 148. The upper mounting base 150 of this embodiment sits atop a pad 152. The pad 152 contacts the surface of the boat. Pad 155 contacts the opposite side of the panel of the boat, and a lower mounting base 159 resides below the pad 155. Nuts 169 and 171 attach to the bolts 167 and 165 to create a fastener that secures the lower mounting base 159 and pad 155. The fastening of the lower mounting base 159 and pad 155 in relation to the upper mounting base 150 and pad 152 then secures the entire mounting base assembly and leg 104 to the boat.

Figure 8:
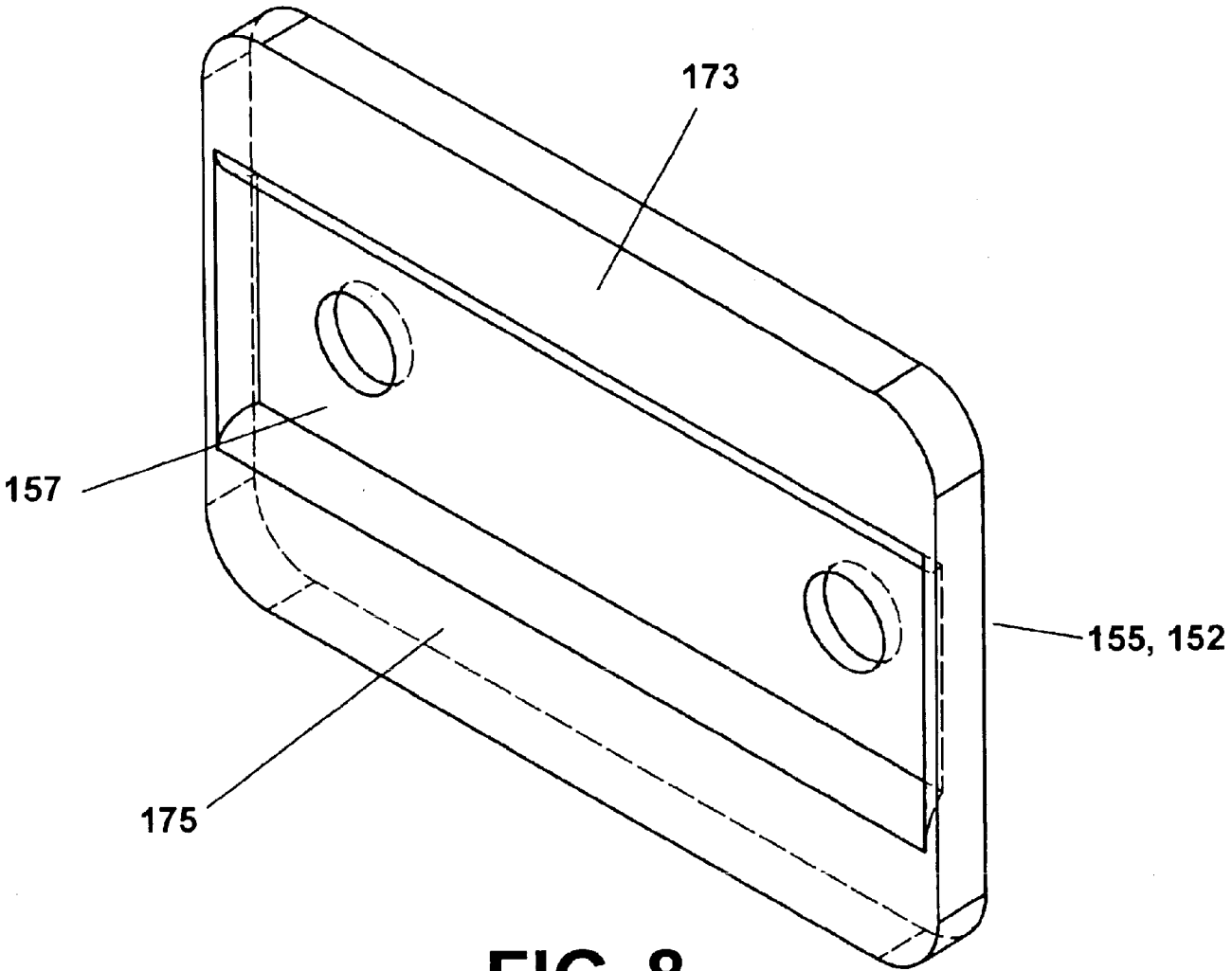
FIG. 8 is a perspective view of a mounting pad of the mounting base assembly.

The pads 152 and 155 include a recessed portion 157 that is more clearly illustrated in FIG. 8. The recessed portion 157 surrounds the mounting holes of the pads 152 and 155 such that only outer portions 173 and 175 contact the surface of the boat. This distributes the weight of the tower and other stresses associated with use of the tower to the boat surface away from the bolt holes that have been drilled through the panel of the boat. This reduces the cracking and chipping at the bolt holes located in the gel coat, fiberglass, and/or other materials included in the boat structure. The pads 152, 155 may be made of various compliant materials such as rubber.

The swivel portions of the mounting base assemblies of the tower 100, such as swivel portion 148 of FIG. 7, may be installed in either of two ways. A shown in FIG. 7, the swivel portion 148 may be installed with one side abutting heim joint 146. However, swivel portion 148 may also be installed by being turned 180 degrees so that the opposite side abuts heim joint 146. FIG. 2 illustrates this variation in the positioning of the swivel portions, with heim joint 146 contacting the opposite side of swivel portion 148 in comparison to FIG. 7.

Figure 4:
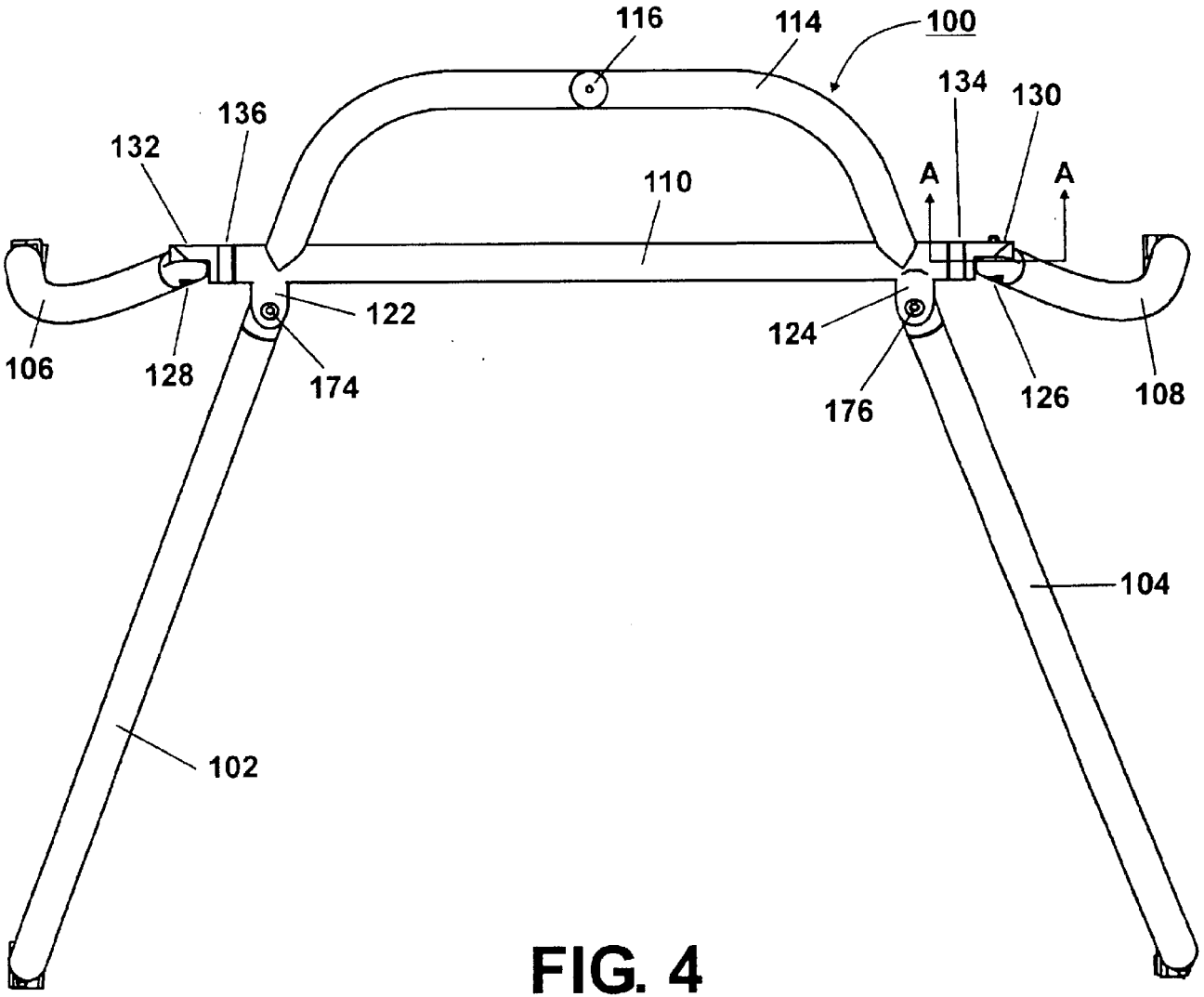
FIG. 4 is a top view of the embodiment.
Figure 5:
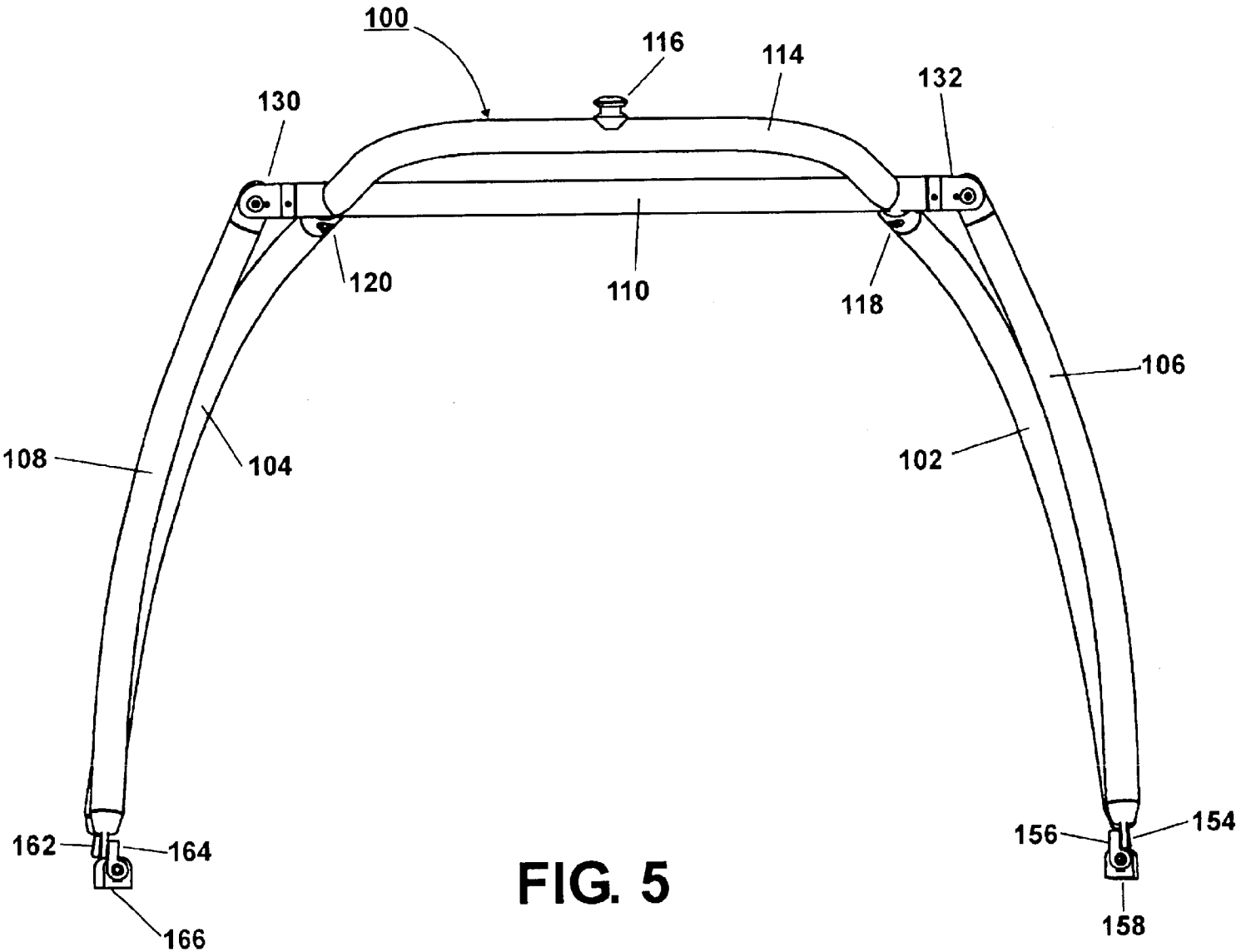
FIG. 5 is a rear elevational view of the embodiment.
Figure 6:
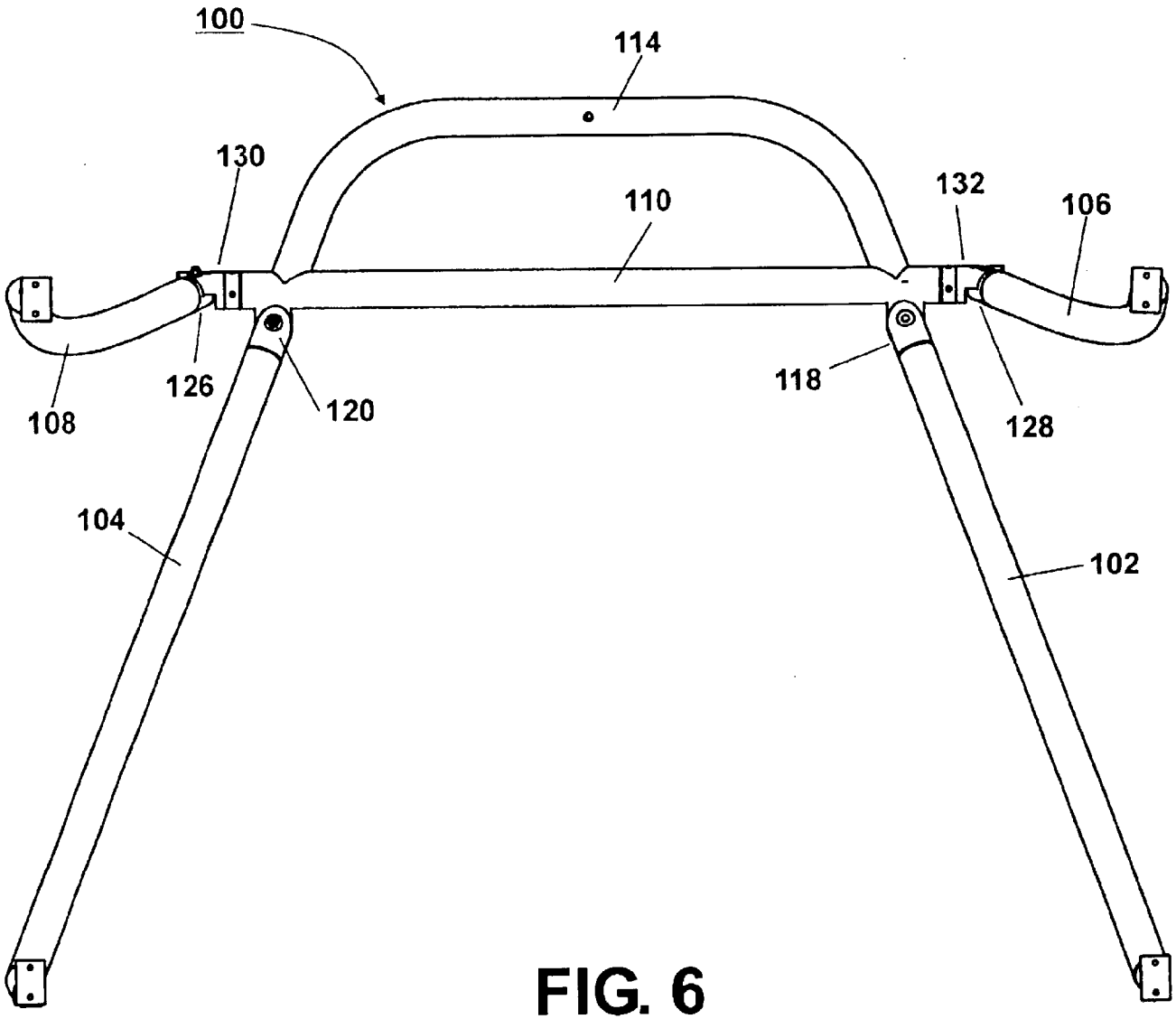
FIG. 6 is a bottom view of the embodiment.
Figure 9:
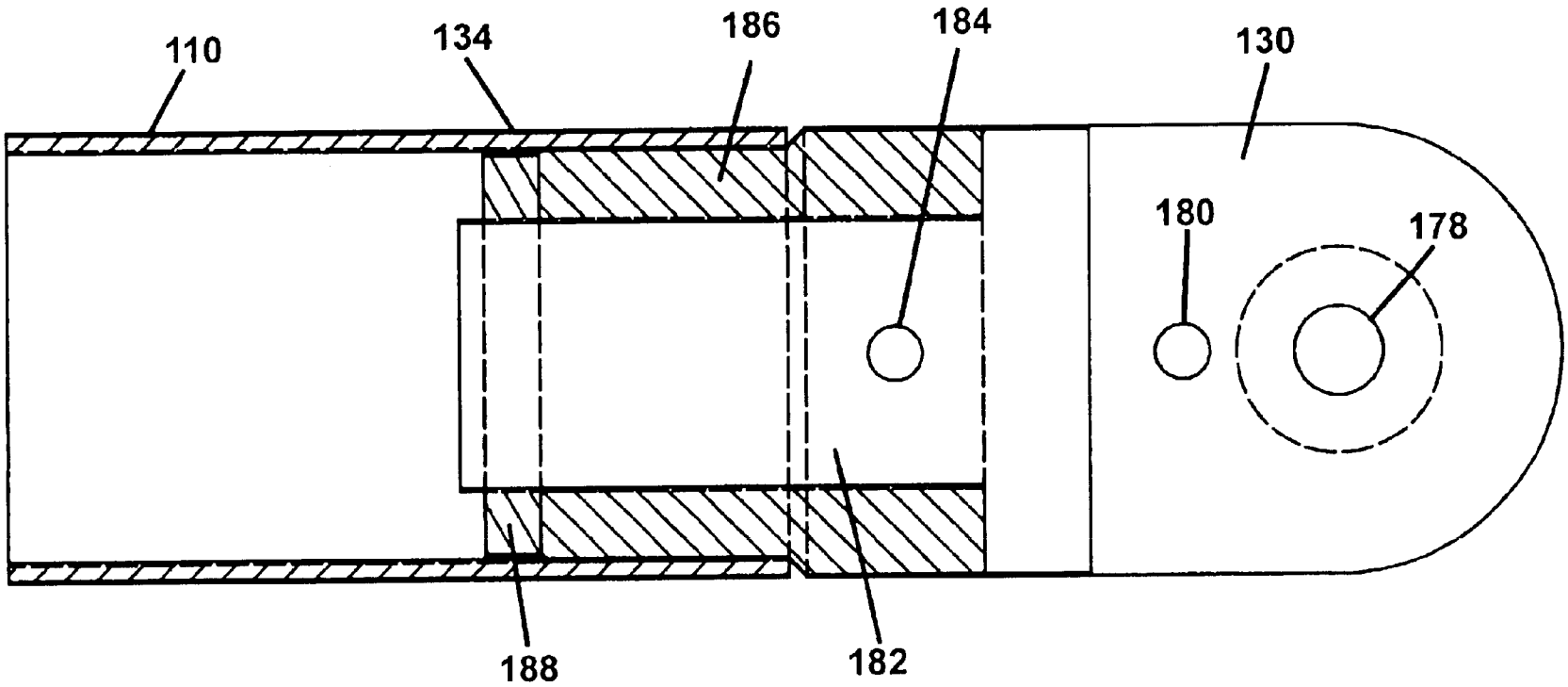
FIG. 9 is a cross-sectional view of a rotating collar of the cross-member.

FIG. 9 shows a cross-sectional view taken through line A—A of FIG. 4 to show the internal construction of the collars of the cross-member 110 that allow the rear legs 106 and 108 to rotate toward and away from the front legs 102 and 104. The collar 134 is illustrated in FIG. 9, but it will be appreciated that the collar 136 is a mirror image. The leg attachment point 130 includes an extension 182 that passes through a hollow center of an endpiece 186 of the cross-member 110. A washer 188 is fixed to the extension 182 such as by a weld after the extension 186 is placed through the hollow center of the endpiece 186. This is done during construction prior to the endpiece 186 being attached to the cross-member 110. The washer 188 abuts the endpiece 186 such that the extension 182 is confined to the endpiece 186 yet rotates within the endpiece 186. After securing the extension 182 to the washer 188, the endpiece 186 is then fixed to the cross-member 110 such as by a weld. The leg attachment point 130 including extension 182 is fixed in the axial direction relative to the cross-member 110 but is free to rotate about the side-to-side longitudinal axis relative to the cross-member 110. Thus, the relationship of the endpiece 186 to the washer 188, extension 182, and attachment point 130 establishes a collar 134 holding the attachment point in place while permitting its rotational movement.

Upon finding the proper degree of rotation relative to the cross-member 110 of the attachment point 130 to place the rear leg in the proper front-to-rear location on the boat structure, a set screw may be tightened within hole 184 to lock the attachment point 130 in place so as to stiffen the tower 100. Furthermore, once the rear leg 108 is rotated into the proper side-to-side location on the boat structure, a set screw or sleeve anchor may be inserted into hole 180 to further stiffen the tower 100. When a sleeve anchor is used, a hole must be created in the swivel portion of the leg that mates to the swivel portion 130 so that the sleeve anchor may extend into the hole in the leg and expand within the hole to stiffen the structure.

As shown in FIGS. 1–6, the cross-member 110 of this particular watersport tower embodiment 100 includes a section 114 that forms a loop with the main cross-member 110. A tow constraint may then be mounted to the section 114. In this embodiment, the tow constraint is a tow lug 116 that a tow rope may be tied around. It will be appreciated that other tow constraints may be used for the tower instead of a lug 116 to provide for the attachment of a tow rope.

When installing the watersport tower embodiment 100 on a boat, the following procedure provides for proper assembly. The swivels and o-rings of the heim joints should be greased. The mounting areas of the boat should be reinforced as necessary (e.g., if less than ⅜ inch thick) to withstand the weight and other forces associated with the watersport tower. Lock nuts and bolts should be appropriately torqued (e.g., to 30–50 ft-lbs).

Initially, it should be decided where to mount the tower. For example, it may be desirable to have the cross-member section 114 rest on a rear seat or sun pad of the boat, so the rear legs should be attached to the cross-member 110 and then the boat attachment location for the rear legs can be determined according to where section 114 rests. The front legs can then be attached to the cross-member at the desired distance from the rear legs (e.g., 48 to 60 inches apart). Once the mounting locations have been determined, the mounting bases may be installed on the boat. At least for the rear legs, the mounting base should be positioned with the raised side facing forward so that the rear legs do not contact the mounting base once the tower has reclined. The leg attachment points may then be connected to the mounting bases to complete installation.

As noted above, set screws and/or sleeve anchors may be utilized to lock the swivel portions of the rear legs and the collars of the cross-member 110 in place to stiffen the structure. Prior to locking the tower into place by fully tightening the bolts and installing the set screws and/or sleeve anchors, it may be desirable to determine whether the tower is centered by measuring from a rear base to the hinge point of the opposite side rear leg and then repeating for the other side. The measurements should be substantially the same (e.g., ¼ inch or less difference).

The tower embodiment 100 described above includes many features. However, various embodiments of the watersport tower invention may include one or more of these features while omitting others. For example, in one embodiment, legs may be able to rotate inward at their attachment point to adjust to various boat widths but not rotate front-to-back. As another example, the legs may be fixed relative to the cross-member, but the mounting bases may rotate relative to the legs to accommodate various mounting location orientations. Accordingly, it will be appreciated that these various features discussed above with reference to FIGS. 1–9 may be present alone or in combination, depending upon the particular needs being addressed by the watersport tower embodiment being constructed.

The tower embodiments may be constructed from various materials. It has been found that hardened aluminum, such as the 6000 series and in particular grades 6061 or 6063 is satisfactory. One alternative to aluminum is stainless steel. Where aluminum is chosen, if the tower will be given a polished finish, then 6063 grade should be used. The aluminum should be heat treated (e.g., from a T5 to a T6 temper). The legs and cross-member may be prepared by milling, then cutting, bending, and welding as necessary, then heat treating, and finishing by powder coating, by anodizing and polishing, or by other similar techniques.

Figure 10:
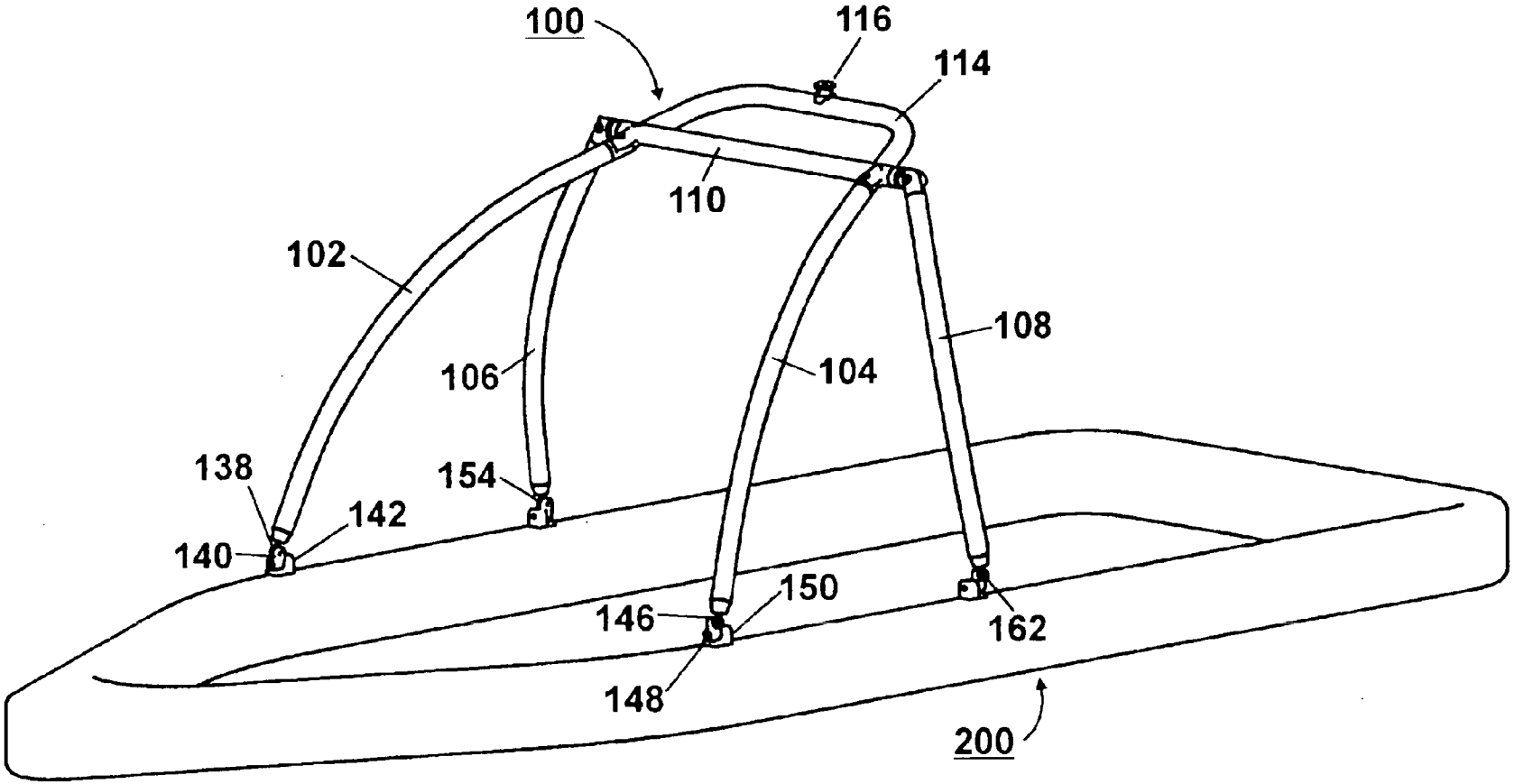
FIGS. 10–12 are a series of perspective views of the embodiment being folded down to a fully reclined state.
Figure 11:
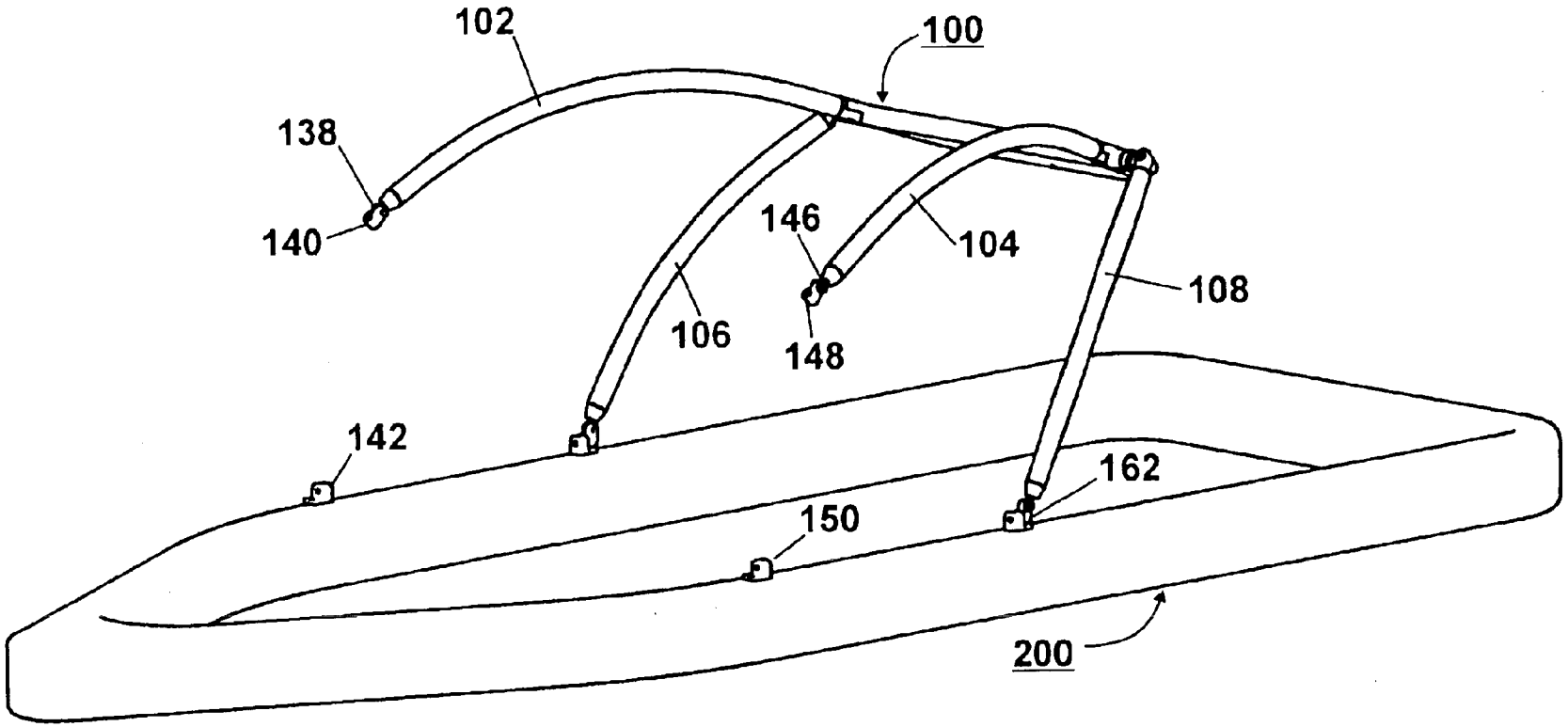
Figure 12:
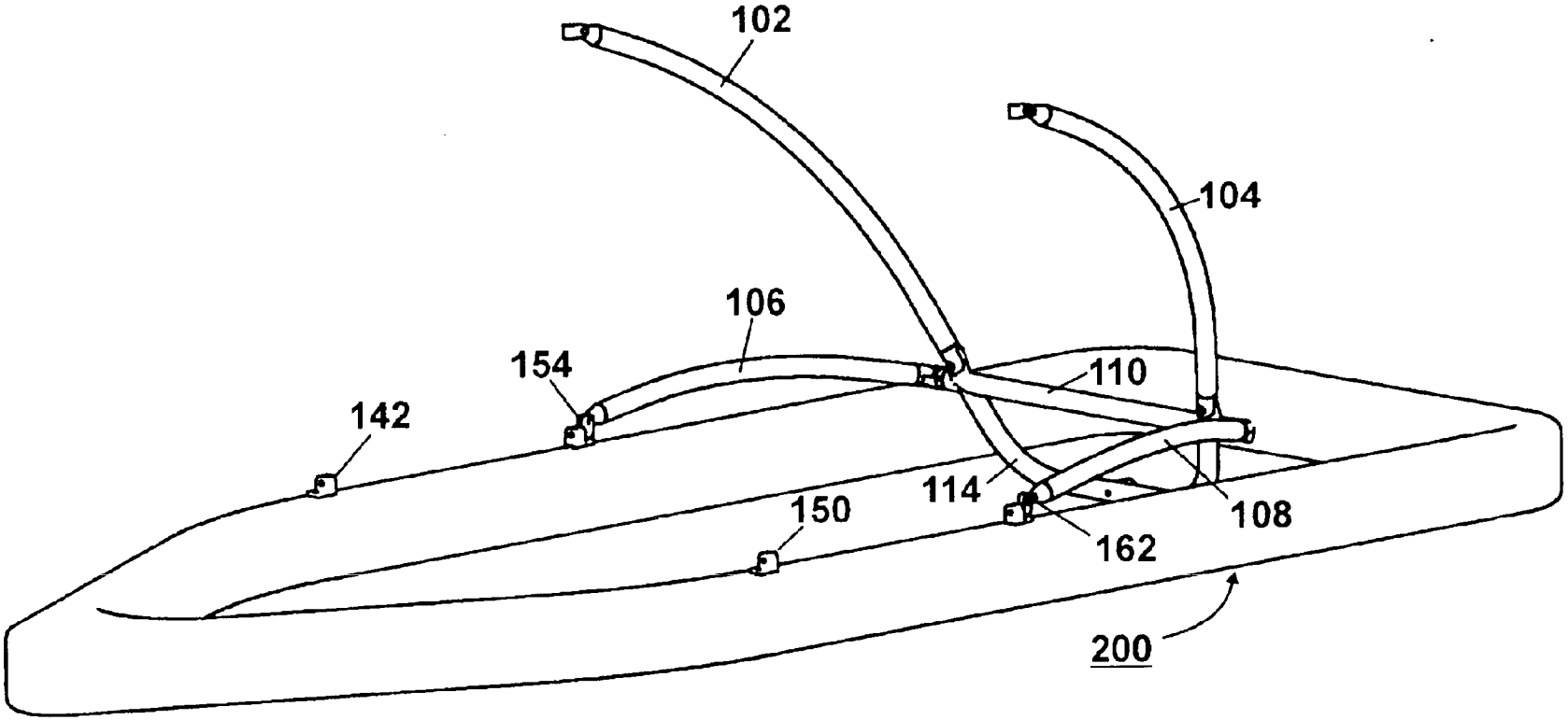
Figure 13:
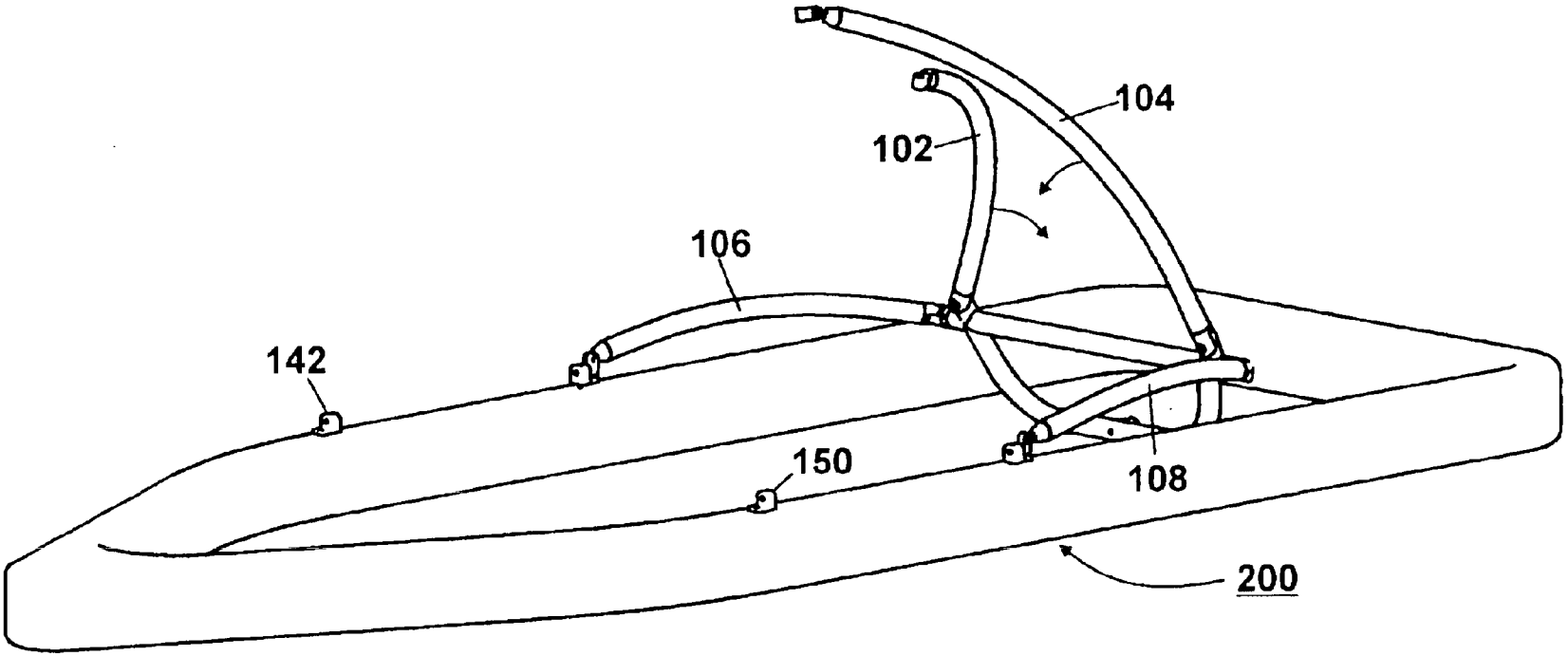
FIGS. 13–14 are a series of perspective views of the embodiment being further folded down from the fully reclined state to a folded state whereby the front legs are crossed until they come to rest.
Figure 14:
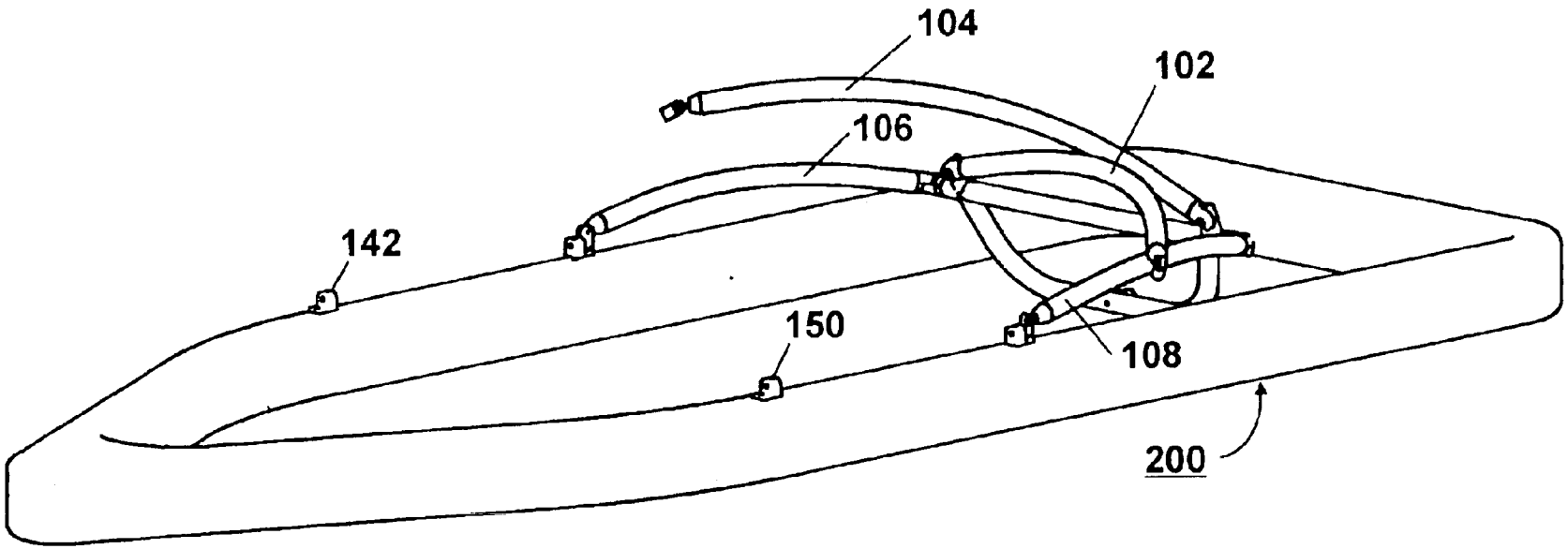

When using certain watersport tower embodiments such as the tower 100, there may be a need to fold it down from time to time when it is not in use. Specifically, when placing a cover over the boat or placing the boat onto an overhead lift, one may desire to fold down the tower 100. FIGS. 10–17 illustrate two alternative ways to fold the tower 100 described above. FIGS. 10–12 show the initial steps that apply to both manners of folding down the tower 100. FIGS. 13 and 14 show the steps specific to the first method of folding the tower while FIGS. 14–17 show the steps specific to the alternative method.

In FIG. 10, the tower 100 sits in the fully upright position on a boat structure 200. So long as the legs are tightly connected to the mounting bases, the tower 100 is in the appropriate state to tow a wakeboarder or other watersport enthusiast or object. Upon the user deciding to fold down the tower 100, the user disconnects the front legs 102, 104 from the mounting bases 142, 150 in one of two ways as noted above in relation to FIG. 7. Either the heim joint 138, 146 can be disconnected from the swivel 140, 148 of the mounting base assembly, or the swivel 140, 148 of the mounting base assembly may be disconnected from the mounting base 142, 150 itself.

Upon disconnecting the front legs, the tower is rotated backwards about the heim joints 154, 162 acting as points of attachment of the rear legs as shown in FIG. 11. As also shown in FIG. 11, for each front leg 102, 104 the user in this instance has disconnected the swivel portion 140, 148 of the mounting base assembly from the mounting base 142, 150 itself. The tower 100 continues to rotate backwards until it reaches its fully reclined state in FIG. 12 where the cross-member section 114 comes to rest by contacting a rear seat, sun pad, floor, or other point of the boat structure 200.

At this point, the user choosing to follow the first manner of folding down the tower 100 takes a first front leg and rotates it toward the second front leg on the opposite side of the boat and then takes the second front leg and rotates it toward the first front leg. As shown in FIG. 13, the user has first rotated leg 102 toward leg 104 and then has rotated leg 104 toward leg 102. It may be desirable to rotate the first front leg until it comes to rest prior to beginning the rotation of the second front leg.

As the front legs rotate, the first front leg eventually comes to rest either against a rear leg on the opposite side of the boat of against a portion of the boat. As shown in FIG. 14, front leg 102 has come to rest against rear leg 108. Then, the second front leg crosses with the first front leg and eventually comes to rest against the first front leg. It can be seen that leg 104 has crossed-over and come to rest against leg 102. Thus, the tower 100 has reached its fully folded down state as shown in FIG. 14, and a boat cover or boat lift may be used. It may be desirable when folding down the tower 100 in this manner to utilize some padding such as a life vest between the points of contact of the cross-member section 114 and each of the legs to preserve the finish of both the tower 100 and the boat 200.

Figure 15:
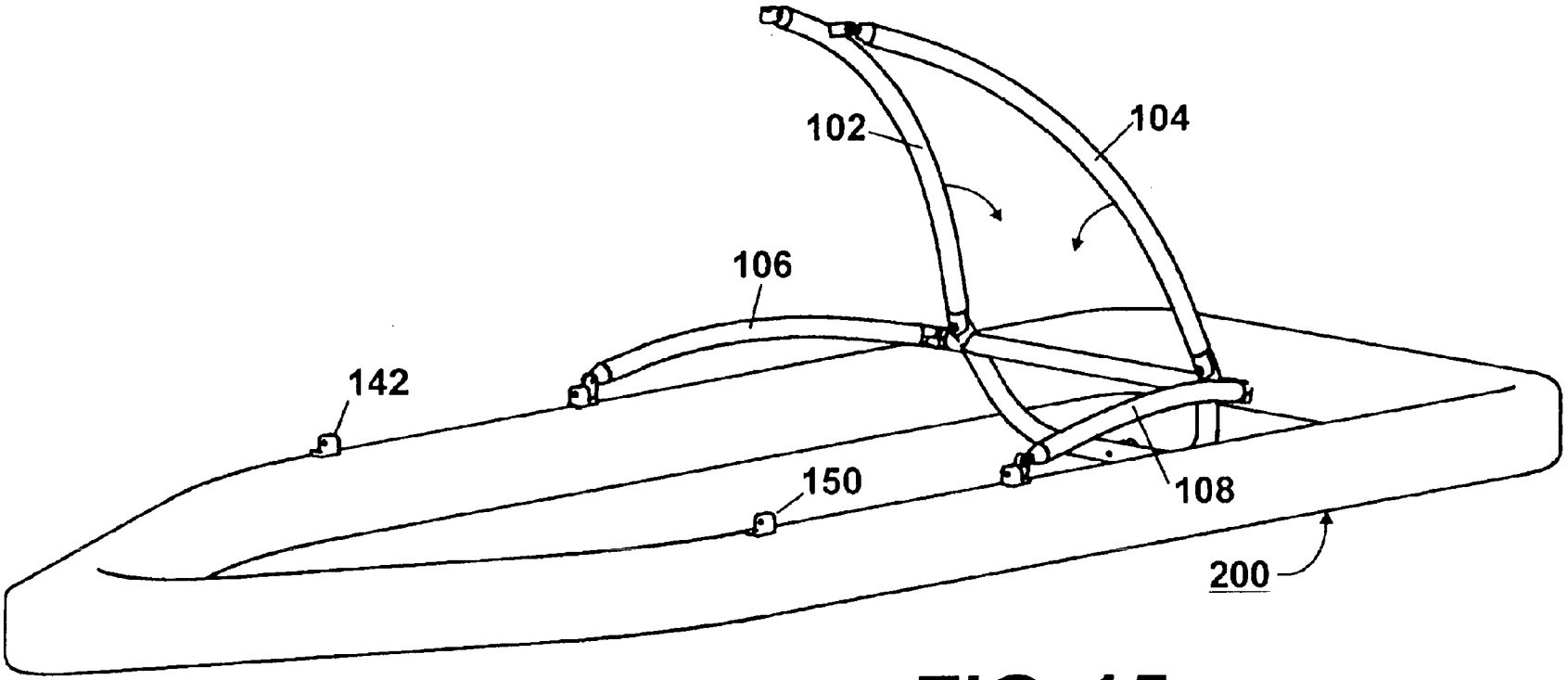
FIGS. 15–17 are a series of perspective views of the embodiment being further folded down from the fully reclined state to a folded state whereby the front legs are rotated downward rather than being fully crossed.
Figure 16:
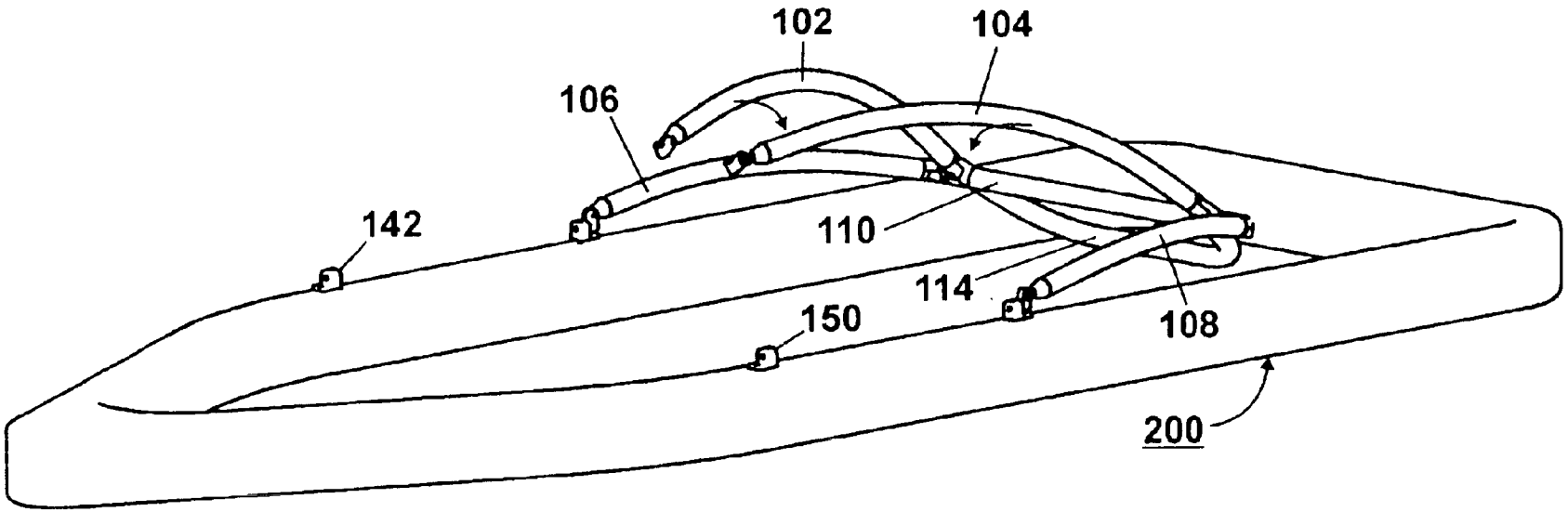

Returning to FIG. 12, at this point the user choosing to follow the second manner of folding down the tower 100 takes a first front leg and rotates is toward the second front leg on the opposite side of the boat and then takes the second front leg and rotates it toward the first front leg. However, the user does not continue to rotate the front legs until they come to rest. Instead, the user rotates them until the boat attachment ends of the legs are in close proximity as shown in FIG. 15.

Figure 17:
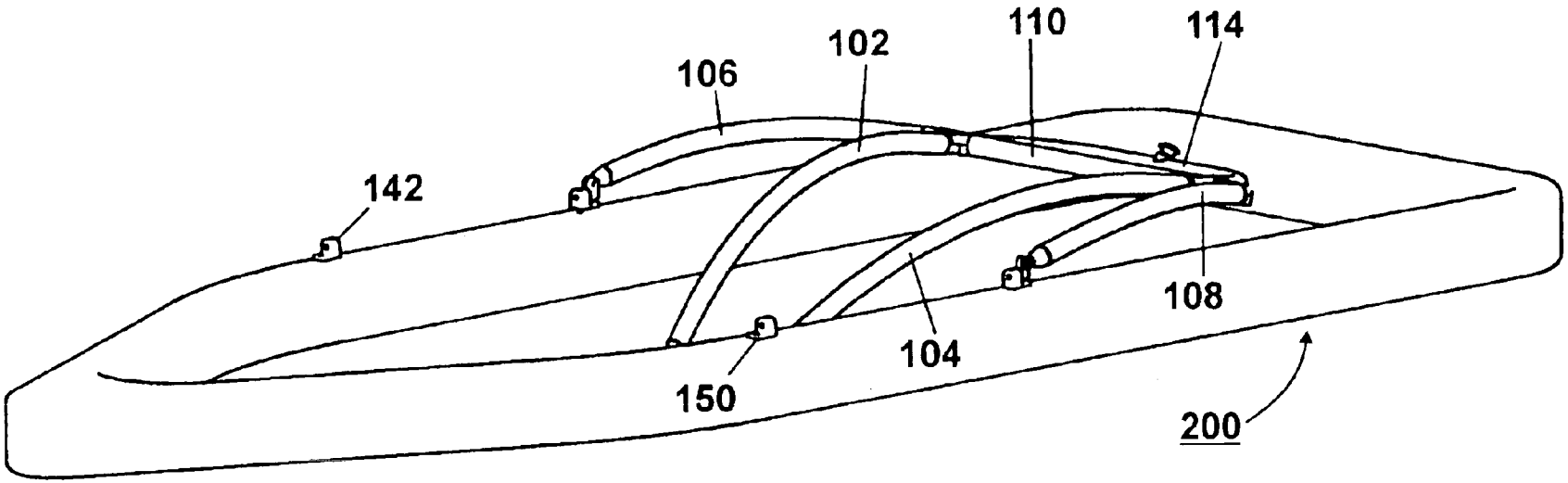

After rotating the front legs toward one another, the user then rotates the cross-member 110 and both of the front legs 102, 104 forward as one unit by having the cross-member 110 rotate relative to the collars 134, 136 that provide the swivel portions attached to the rear legs 106, 108. Thus, the cross-member 110 and front legs 102, 104 attached to the cross-member 110 rotate forward while the rear legs 106 and 108 continue to be reclined. If a set screw was inserted to lock the collars 134, 136, then the set screw should be loosened prior to attempting to rotate the cross-member 110 forward. Eventually, the boat attachment ends of the front legs 102, 104 contact the boat structure 200 and come to rest in the fully folded state as shown in FIG. 17, and a boat cover or boat lift may be used. Again, it may be desirable when folding down the tower 100 in this manner to utilize some padding such as a life vest between the points of contact of the cross-member section 114 and each of the legs to preserve the finish of both the tower 100 and the boat 200.

Figure 18:
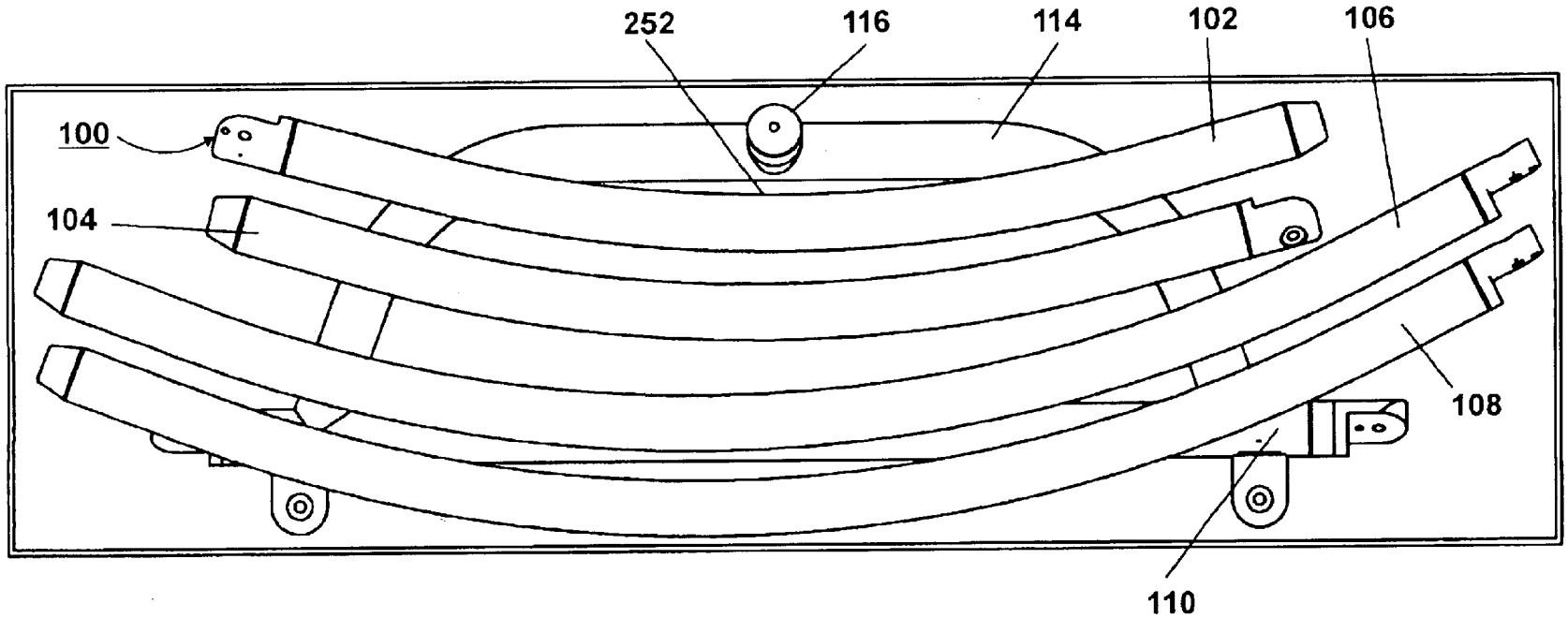
FIG. 18 is a top view of the embodiment in a disassembled and packaged state for shipment.
Figure 19:
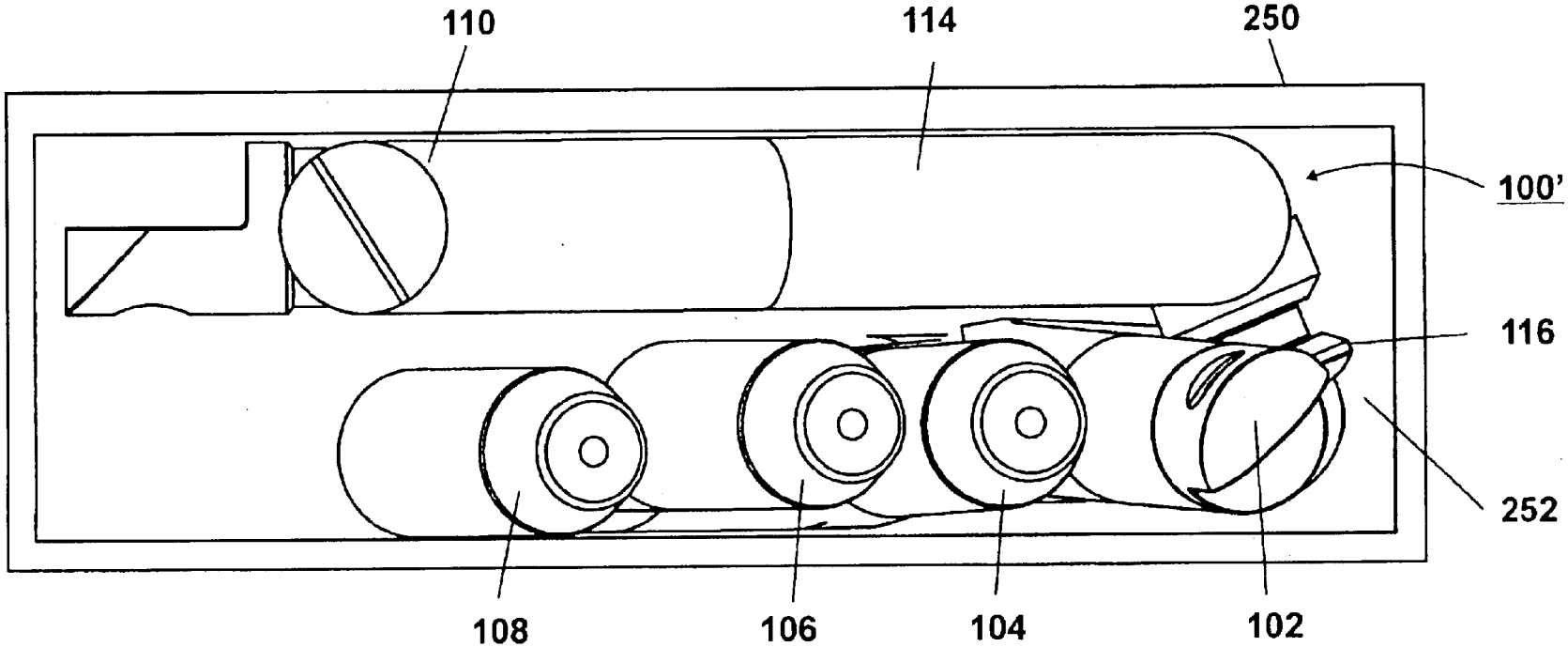
FIG. 19 is a side view of the embodiment in the disassembled and packaged state for shipment.

In addition to folding down into a manageable configuration, the tower 100 may also be packaged in a disassembled state to be transported. As shown in FIGS. 18 and 19, this disassembled watersport tower embodiment 100' may be packaged in a relatively small container 250. Because the legs 102, 104, 106 and 108 have a very similar curvature, these legs may be placed side-by-side so that they are substantially concentric as shown in FIGS. 18 and 19.

In this concentric formation, an empty region 252 is created by the curvature of the innermost leg 102. By stacking the concentric formation of legs with the cross-member 110, the tow lug 116 on the section 114 of the cross-member 110 may then extend into the empty region 252. As best seen in FIG. 19, this stacked configuration provides the legs forming one plane with the cross-member forming a second planed adjacent the plane of the legs, with the tow lug 116 extending into the empty region 252 of the plane defined by the concentric legs. Accordingly, the disassembled tower 100' may be packaged in a relatively small enclosure 250 that is suitable for shipment by various commercial carriers.

While the invention has been particularly shown and described with reference to various embodiments thereof, it will be understood by those skilled in the art that various other changes in the form and details may be made therein without departing from the spirit and scope of the invention.

What is claimed is:

1. A watersport tower, comprising:

a first leg including a first end providing a cross-member attachment point and a second end providing a boat attachment point;

a second leg including a first end providing a cross-member attachment point and a second end providing a boat attachment point;

a cross-member including at least two attachment points, the cross-member attachment point of the first leg being hingedly connected to a first attachment point of the cross-member, and the cross-member attachment point of the second leg being hingedly connected to a second attachment point of the cross-member, and wherein the first leg pivots about the hinged connection to the first attachment point to swing toward and away from the second leg and the second leg pivots about the hinged connection to the second attachment point to swing toward and away from the first leg;

a third leg including an end providing a boat attachment point, the third leg linked to the cross-member;

a fourth leg including an end providing a boat attachment point, the fourth leg linked to the cross-member; and a tow constraint linked to the cross-member.

2. The watersport tower of claim 1, wherein the third leg and fourth leg each comprise an end providing a cross-member attachment point, wherein the cross-member further comprises third and fourth attachment points, wherein the cross-member attachment point of the third leg is hingedly connected to the third attachment point of the cross-member, wherein the cross-member attachment point of the fourth leg is hingedly connected to the fourth attachment point of the cross-member, and wherein the third leg pivots about the third attachment point and the fourth leg pivots about the fourth attachment point to allow the third leg to swing toward and away from the fourth leg and to allow the fourth leg to swing toward and away from the third leg.

3. The watersport tower of claim 1, wherein the third leg and fourth leg each comprise an end providing a cross-member attachment point, wherein the cross-member further comprises a central portion and third and fourth attachment points that rotate relative to the central portion, wherein the cross-member attachment point of the third leg is attached to the third attachment point of the cross-member, wherein the cross-member attachment point of the fourth leg is attached to the fourth attachment point of the cross-member, and wherein the third and fourth attachment points rotate relative to the central portion to allow the third leg to swing toward and away from the first leg and to allow the fourth leg to swing toward and away from the second leg.

4. The watersport tower of claim 1, further comprising:

an upper mounting base at the boat attachment point of each leg;

a heim joint interconnecting each mounting base to the boat attachment point of each leg;

a first pad abutting the upper mounting base opposite the heim joint;

a lower mounting base linked to the upper mounting base by a fastener; and a second pad abutting the lower mounting base.

5. The watersport tower of claim 1, wherein each leg and the cross-member are aluminum.

6. The watersport tower of claim 1, wherein each leg is curved in multiple planes.

7. A watersport tower, comprising:

a first leg including an end providing a boat attachment point;

a second leg including an end providing a boat attachment point;

a third leg including a first end providing a cross-member attachment point and a second end providing a boat attachment point;

a fourth leg including a first end providing a cross-member attachment point and a second end providing a boat attachment point;

a cross-member linked to the first and second legs and including at least two attachment points separated by a central portion, wherein the cross-member attachment point of the third leg is attached to a first attachment point of the cross-member, wherein the cross-member attachment point of the fourth leg is attached to a second attachment point of the cross-member, and wherein the third and fourth attachment points rotate relative to the central portion to allow the third leg to swing toward and away from the first leg and to allow the fourth leg to swing toward and away from the second leg; and a tow constraint linked to the cross-member.

8. The watersport tower of claim 7, wherein the cross-member attachment point of the third leg is hingedly connected to the first attachment point of the cross-member, wherein the cross-member attachment point of the fourth leg is hingedly connected to the second attachment point of the cross-member, and wherein the third leg pivots about the third attachment point and the fourth leg pivots about the fourth attachment point to allow the third leg to swing toward and away from the fourth leg and to allow the fourth leg to swing toward and away from the third leg.

9. The watersport tower of claim 7, further comprising:

an upper mounting base at the boat attachment point of each leg;

a heim joint interconnecting each mounting base to the boat attachment point of each leg;

a first pad abutting the upper mounting base opposite the heim joint;

a lower mounting base linked to the upper mounting base by a fastener; and a second pad abutting the mounting base.

10. The watersport tower of claim 7, wherein each leg and the cross-member are aluminum.

11. The watersport tower of claim 7, wherein each leg is curved in multiple planes.

12. A watersport tower, comprising:

a first leg including a first end providing a cross-member attachment point and a second end providing a boat attachment point;

a second leg including a first end providing a cross-member attachment point and a second end providing a boat attachment point;

a third leg including a first end providing a cross-member attachment point and a second end providing a boat attachment point;

a fourth leg including a first end providing a cross-member attachment point and a second end providing a boat attachment point;

a cross-member including four attachment points, the cross-member attachment point of the first leg being hingedly connected to a first attachment point of the cross-member, and the cross-member attachment point of the second leg being hingedly connected to a second attachment point of the cross-member, wherein the first leg pivots about the hinged connection to the first attachment point to swing toward and away from the second leg and the second leg pivots about the hinged connection to the second attachment point to swing toward and away from the first leg, wherein the cross-member attachment point of the third leg is hingedly connected to the third attachment point of the cross-member, wherein the cross-member attachment point of the fourth leg is hingedly connected to the fourth attachment point of the cross-member, and wherein the third leg pivots about the third attachment point and the fourth leg pivots about the fourth attachment point to allow the third leg to swing toward and away from the fourth leg and to allow the fourth leg to swing toward and away from the third leg, wherein the cross-member further comprises a central portion, and wherein the third and fourth attachment points rotate relative to the central portion to allow the third leg to swing toward and away from the first leg and to allow the fourth leg to swing toward and away from the second leg; and a tow constraint linked to the cross-member.

13. The watersport tower of claim 12, further comprising:

an upper mounting base at the boat attachment point of each leg;

a heim joint interconnecting each mounting base to the boat attachment point of each leg;

a first pad abutting the upper mounting base opposite the heim joint;

a lower mounting base linked to the upper mounting base by a fastener; and a second pad abutting the lower mounting base.

14. The watersport tower of claim 12, wherein each leg and the cross-member are aluminum.

15. The watersport tower of claim 12, wherein each leg is curved in multiple planes.

16. A watersport tower, comprising:

a plurality of coupled legs, each leg providing a boat attachment point;

a tow constraint coupled to the plurality of legs;

a first set of mounting bases, each mounting base being coupled to one of the boat attachment points and each mounting base including at least one mounting hole; and a first set of pads, each pad abutting a mounting base of the first set and including at least one mounting hole in registry with the at least one mounting hole of the mounting base from the first set, each pad including a recessed portion surrounding the at least one mounting hole on a side of the pad opposite the mounting base of the first set.

17. The watersport tower of claim 16, further comprising:

a second set of mounting bases, each mounting base including at least one mounting hole in registry with the at least one mounting hole of the mounting base from the first set and each mounting base of the second set being coupled to one mounting base of the first set via a fastener passing through the mounting hole of the mounting bases of the first set and second set; and a second set of pads, each pad of the second set abutting a mounting base of the second set and including at least one mounting hole in registry with the at least one mounting hole of the mounting base from the second set, each pad of the second set including a recessed portion surrounding the at least one mounting hole on a side of the pad opposite the mounting base of the second set.

18. The watersport tower of claim 16, each leg is coupled to one of the boat attachment points by a heim joint.

19. A watersport tower, comprising:

a plurality of coupled legs including front and rear legs for left and right sides, each leg providing a boat attachment point;

a tow constraint coupled to the plurality of legs;

swivel members connected to the boat attachment point of each leg and including a bolt hole;

mounting bases of a first set, each including a bolt hole and each abutting a swivel member with the bolt hole of the mounting base in registry with the bolt hole of the swivel member; and a bolt passing through the bolt hole of each mounting base and the bolt hole of each swivel member to provide an axis of rotation of the mounting base relative to the swivel member such that the mounting base rotates relative to the leg until the bolt is tightened to fix the mounting base against the swivel.

20. The watersport tower of claim 19, wherein each swivel portion is coupled to the boat attachment point by a heim joint that is fixed to the boat attachment point.

21. The watersport tower of claim 19, further comprising:

a first set of pads, each pad abutting a mounting base of the first set and including at least one mounting hole in registry with the at least one mounting hole of the mounting base from the first set, each pad including a recessed portion surrounding the at least one mounting hole on a side of the pad opposite the mounting base of the first set;

a second set of mounting bases, each mounting base including at least one mounting hole in registry with the at least one mounting hole of the mounting base from the first set and each mounting base of the second set being coupled to one mounting base of the first set via a fastener passing through the mounting hole of the mounting bases of the first set and second set; and a second set of pads, each pad of the second set abutting a mounting base of the second set and including at least one mounting hole in registry with the at least one mounting hole of the mounting base from the second set, each pad of the second set including a recessed portion surrounding the at least one mounting hole on a side of the pad opposite the mounting base of the second set.

22. A method of folding a wakeboard tower that has two front legs and two rear legs and that is mounted to a boat, comprising:

rotating the wakeboard tower about a point of attachment of the two rear legs to the boat until the wakeboard tower comes to rest in a reclined position; and after rotating the wakeboard, rotating the two front legs inward until one front leg crosses-over the other front leg and comes to rest.

23. A method of folding a wakeboard tower that has two front legs and two rear legs and that is mounted to a boat, comprising:

rotating the wakeboard tower about a point of attachment of the two rear legs to the boat until the wakeboard tower comes to rest in a reclined position;

after rotating the wakeboard, rotating the two front legs inward and stopping prior to the front legs coming to rest; and after rotating the two front legs inward, rotating the two front legs downward until the two front legs come to rest.

24. A method of packaging components of a watersport tower comprising a cross-member with a tow lug and a plurality of curved legs, the method comprising:

positioning the plurality of curved legs side by side such that the curvature of the plurality of curved legs is substantially concentric and so that an innermost curved leg defines a central empty region, the plurality of curved legs defining a first plane; and positioning the plurality of curved legs in a stacked configuration with the cross-member such that the tow lug of the cross-member extends into the central empty region, the cross-member defining a second plane that is adjacent the first plane.

* * * * *